US006850070B2

(12) United States Patent
McQueeney et al.

(10) Patent No.: US 6,850,070 B2
(45) Date of Patent: Feb. 1, 2005

(54) COIL ON PLUG INDUCTIVE SAMPLING METHOD

(75) Inventors: Kenneth A. McQueeney, Los Gatos, CA (US); Robert R. Bryant, San Jose, CA (US)

(73) Assignee: Snap-On Incorporated, Pleasant Prairie, WI (US)

( * ) Notice: Subject to any disclaimer, the term of this patent is extended or adjusted under 35 U.S.C. 154(b) by 154 days.

(21) Appl. No.: 10/208,196

(22) Filed: Jul. 31, 2002

(65) Prior Publication Data

US 2003/0038635 A1 Feb. 27, 2003

Related U.S. Application Data

(60) Provisional application No. 60/308,562, filed on Jul. 31, 2001.

(51) Int. Cl.[7] ..... F02P 17/00
(52) U.S. Cl. ..... 324/388; 324/525
(58) Field of Search ..... 324/388, 525

(56) References Cited

U.S. PATENT DOCUMENTS 4,008,430 A 2/1977 Blum
4,090,125 A 5/1978 Warner
4,146,833 A 3/1979 McKinnon

FOREIGN PATENT DOCUMENTS

EP 1088989 4/2001

*Primary Examiner*—Charles H Nolan, Jr.
(74) *Attorney, Agent, or Firm*—McDermott Will & Emery LLP

(57) ABSTRACT

A coil-on plug testing apparatus generates an output signal representing an ignition signal. The testing apparatus includes an inductive sensor for detecting an electromagnetic flux generated by a coil-on plug device during a firing event and generating and outputting a voltage in response thereto, and a signal processing circuit electrically connected to the inductive sensor for generating an output signal in response to variations in the voltage output by the inductive sensor. A method for determining burn time for a coil-on plug ignition includes disposing an inductive sensor adjacent to a coil-on plug ignition housing, using the inductive sensor to detect an electromagnetic flux output by the coil-on plug ignition during a period encompassing at least one firing section, and determining a burn time by identifying a firing line, identifying an endpoint of a spark line and determining a time period therebetween.

21 Claims, 23 Drawing Sheets

COIL ON PLUG INDUCTIVE SAMPLING METHOD

CROSS-REFERENCE TO PROVISIONAL APPLICATION

This application claims priority from U.S. Provisional Patent Application Ser. No. 60/308,562 filed Jul. 31, 2001, the entire disclosure of which is incorporated herein by reference.

TECHNICAL FIELD

The disclosure relates to engine analyzers for internal combustion engine direct ignition systems inclusive of coil-on plug or coil-over plug ignitions and, more particularly, to engine analyzers employing ignition signal pickups to detect ignition waveforms in direct ignition systems. The disclosure has particular applicability to automotive engine analysis in which secondary ignition waveforms and the numerical value of segments of such waveforms are displayed for technician evaluation.

BACKGROUND DISCUSSION

Engine analyzers provide mechanics with a tool for accurately checking the performance of the ignition system as a measure of the overall engine performance. Signal detectors ("test probes") are widely used in diagnosing defects and anomalies in internal combustion engines. A test probe is, for example, placed adjacent to a test point such as a ignition coil or ignition wire, and the test probe communicates the signal back to a motor vehicle diagnostic apparatus. Information obtained from the test probe, such as spark plug firing voltage and duration, can help a mechanic determine if a spark plug associated with the ignition coil is functioning properly.

FIG. 1*a* illustrates a capacitive signal detection system. Ignition coil 110 is, essentially, a transformer having a very large turn ratio, typically between 1:50 to 1:100, between the primary and secondary, which transforms the low voltage in a primary winding provided by the sudden opening of the primary current to a high voltage in a secondary winding. Ignition coil 110 is connected to the center or coil terminal (not numbered) of distributor cap 114 by an insulated wire 112. High voltage from the ignition coil 110 is distributed from the coil terminal to side or spark plug terminals of the distributor cap 114 by means of a rotor which distributes the spark to each spark plug terminal at a predetermined timing in a manner known to those skilled in the art and provided in standard technical manuals. The spark voltage provided to the spark plug terminals is, in turn, provided to a corresponding spark plug 122 via insulated wires 118.

At each cylinder, the resulting electric discharge between the spark plug electrodes produces a spark which ignites a fuel-air mixture drawn or forced into the cylinder and compressed to an explosive state, thereby driving a piston in the cylinder to provide power to an attached crankshaft. Analysis of ignition waveforms to evaluate engine performance can be performed by capacitively coupling a capacitive signal pickup 124 to the spark plug wire 118. The capacitive signal pickup 124 is conventionally wrapped around or clipped to wire 118, at one end, and is connected to measuring device 128, at another end, through a wire or coaxial cable 126. The total capacity measured by the pickup 124 is used, in combination with a conventional capacity divider circuit, to determine the wire 118 voltage in a manner known to those skilled in the art.

More recently, ignition systems have evolved to one coil per cylinder or one coil per cylinder pair (a direct ignition system (DIS) or hybrid), and may not have any spark plug wire at all. Such spark ignition systems incorporate an ignition coil over each plug or an ignition coil near each plug as shown, for example, in FIG. 1*b*. High voltage generated at the secondary coil 164 by means of the primary coil 162 and magnetic iron core 160 is routed through the output of the secondary coil through various conductive elements to a conductive output, such as a spring 169, and to the spark plug (not shown) housed within spark plug cap 160. Igniter 168 is a switch that opens after current has been flowing in the coil. This transient develops a large voltage on the primary which is increased by transformation through secondary coil.

FIG. 1*c* shows a coil-over-plug (COP) assembly having ignition coil 140, spark plug 150, and spark plug gap 151. This arrangement prevents application of the conventional technique implemented in FIG. 1*a*, since the high secondary voltage conductor is not as easily accessed as the wire 118 of FIG. 1*a*. For this configuration of COP, a coil-on plug signal detector assembly or sensor 141, such as taught by U.S. Pat. No. 6,396,277, issued on May 28, 2002, and assigned to the present assignee, which is incorporated herein by reference, may be used. The COP sensor 141 includes upper and lower conductive layers (not shown) affixed to and separated by substrate 144. The upper and lower conductive layers act, in one aspect, as a signal detector and as a ground plane. The upper layer is conductively coupled to an external signal analyzer device via wire 152 and the ground plane reflects a portion of the electromagnetic energy generated by the coil, thus serving to attenuate the strength of the signal observed at the signal detector layer to a level easily handled by conventional analyzers. The sensor 141 is clipped to the housing of the ignition coil 140 by a clip 147 attached to sensor housing 148.

In this arrangement, sensor 141 lies within a field of electromagnetic radiation emitted by coil 140 when the coil is transforming primary voltage into high-voltage for use by a spark plug. In operation, low voltage and high current are applied to the primary winding of ignition coil 140 for a predetermined time, and the primary winding generates an electromagnetic field that principally consists of a magnetic field (H). The secondary winding generates an electromagnetic field that is primarily an electric field (E) because it carries high voltage and low current. The lower conductive layer, which is placed adjacent a housing of the coil 140, is brought substantially to ground potential by virtue of such contact. A voltage potential, which could be positive or negative (generally negative for a COP system), is induced or otherwise developed across upper and lower layers 148, and may be measured at or received from the surface of the upper layer or signal detector layer. The voltage observed at the signal detection layer is proportional to the voltage at the terminal end of the secondary coil of coil 140. A signal taken from the signal detection layer may therefore be used in diagnosing ignition spark voltage characteristics, such as spark voltage or burn time, or other problems such as open wires or plugs or fouled or shorted plugs, in a manner known to those skilled in the art.

Despite the advancements realized by present coil-on plug signal detection devices, the sheer variety of ignition coil configurations make it difficult for any one sensor to find universal applicability. For example, the aforementioned sensor 141 may be less than optimal when the coil housing is shielded or otherwise configured to output a distorted or significantly attenuated signal. One example of this occurs in coil-on plug/coil-over plug assemblies bearing an igniter in a ferrous shielded box, which acts a shield for both electric and magnetic fields emanating from the core. Shielding is broadly considered to include any medium or combinations of mediums that serve to notably attenuate a field output from the coil-on plug assembly, even if such shielding was not itself a design consideration. Therefore, there is a need for a coil-on plug/coil-over plug signal detection device suitable for use in low-output ignition coil configurations.

SUMMARY OF THE INVENTION

In one aspect, a coil-on plug testing apparatus is provided for generating an output signal representing an ignition signal. The testing apparatus includes an inductive sensor for detecting an electromagnetic flux generated by a coil-on plug device during a firing event, and generating and outputting a voltage in response thereto. The inductive sensor is attached to the coil-on plug device. A signal processing circuit electrically connected to the inductive sensor generates an output signal in response to variations in the voltage output by the inductive sensor.

In another aspect, a method for determining burn time for a coil-on plug ignition includes disposing an inductive sensor adjacent a coil-on plug ignition housing, using the inductive sensor to detect an electromagnetic flux output by the coil-on plug ignition during a period encompassing at least one firing section, and determining a burn time. The burn time is determined by identifying a firing line and identifying an endpoint of a spark line, and determining the time between the firing line and the endpoint of the spark line.

In yet another aspect, a method for detecting problems associated with a coil-on plug ignition includes disposing an inductive sensor adjacent a first coil-on plug housing, using the inductive sensor to detect an electromagnetic flux output by the coil-on plug ignition during a period encompassing at least one firing section, and identifying at least one of a firing line, spark line, and burn time. These steps are repeated for a second coil-on plug and a comparison is made between at least one of a corresponding firing line, spark line, and burn time identified with respect to the first and second coil-on plugs to determine a relative difference therebetween.

In another aspect, a method for detecting problems with respect to a coil-on plug ignition includes disposing a sensor adjacent a first coil-on plug housing, using the sensor to detect electromagnetic radiation emitted by the coil-on plug ignition during a period encompassing at least one firing section, and identifying at least one of a firing line, spark line, and burn time. These steps are repeated for a second coil-on plug and a comparison is made between at least one of a corresponding firing line, spark line, and burn time identified with respect to the first and second coil-on plugs to determine a relative difference therebetween.

DESCRIPTION OF THE EMBODIMENTS

Figure 2A:
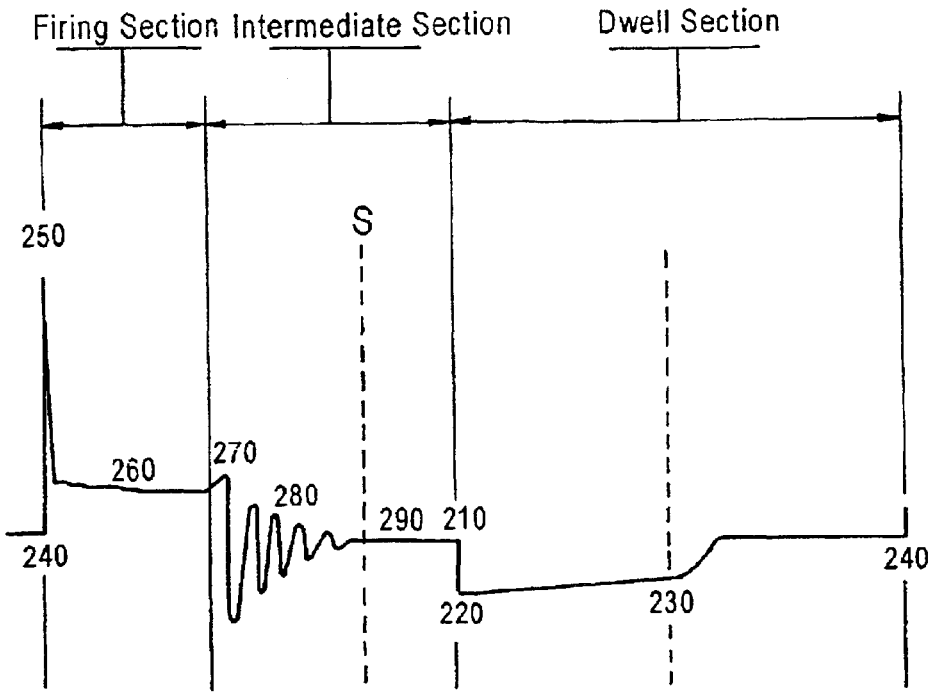
FIGS. 2*a* and 2*b* respectively depict a typical primary ignition waveform and secondary ignition waveform displayed as a function of time.
Figure 2B:
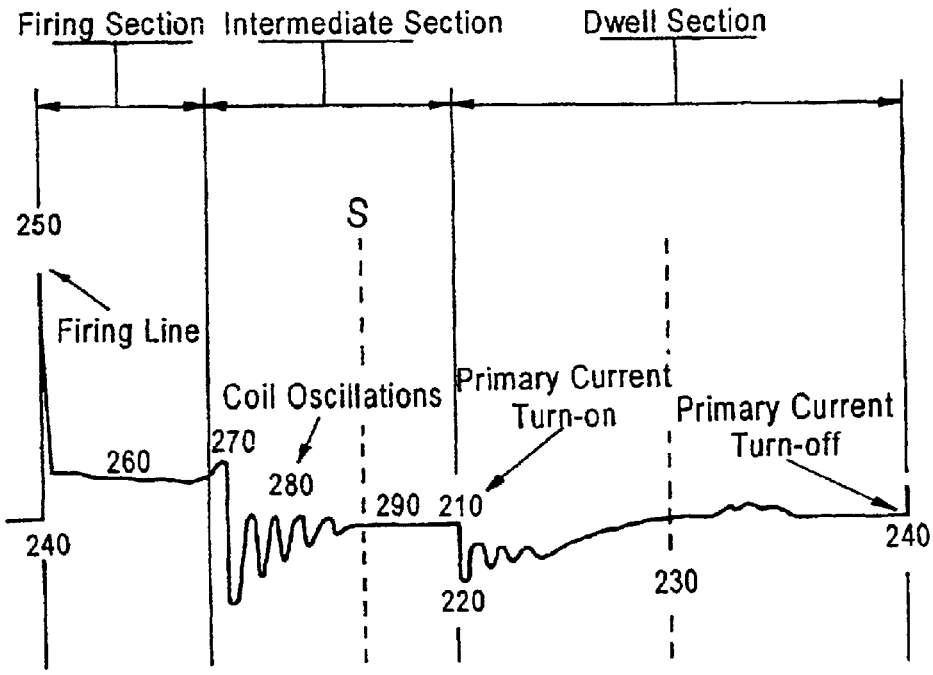

FIGS. 2*a* and 2*b* illustrate, respectively, a typical primary ignition waveform and secondary ignition waveform as a function of time. The waveforms have three basic sections labeled Firing Section, Intermediate Section, and Dwell Section.

Common reference numerals are used in FIGS. 2*a* and 2*b* to represent common events occurring in both the primary and secondary waveforms. At the start S of the waveform, no current flows in the primary ignition circuit. Battery or charging system voltage available at this point generally ranges from approximately 12–15 volts, but is typically between about 12–14 volts. At 210, the primary switching device turns on the primary current to start the "dwell" or "charge" section. At 220, current flows through the primary circuit, establishing a magnetic field in the ignition coil windings A rise in voltage occurs along 230 indicating that coil saturation is occurring and, on ignition systems that use coil saturation to control coil current, a current hump or voltage ripple appears at this time. The part of the waveform representing primary circuit on-time is between points 210 and 240. Thus, the portion of the signal between points 210 and 240 represents the dwell period or "on-time" of the ignition coil primary current.

The primary switching device terminates the primary current flow at 240, suddenly causing the magnetic field that had built up to collapse and induce a high voltage in the primary winding by self-induction. An even higher voltage is induced, by mutual induction, into the secondary winding, because of a typical 1:50 to 1:100 primary to secondary turns ratio. The secondary voltage is delivered to the spark plug gap, and the spark plug gap is ionized and current arcs across the electrodes to produce a spark 250 (i.e., the "firing line") to initiate combustion and the spark continues for a period of time called the "firing section" or "burn time" 260.

The firing line 250, measured in kilovolts, represents the amount of voltage required to start a spark across the spark plug gap, and is generally between about 3–8 kV. The burn time 260 represents the duration of the spark event, is generally between about 1–3 milliseconds and is inversely related to the firing kV. If the firing kV increases, burn time decreases and vice versa. Over the burn time 260, the discharge voltage across the air gap between spark plug electrodes decreases until the coil energy cannot sustain the spark across the electrodes (see e.g., 270). At 280, an oscillating or "ringing" voltage results and continues until, at 290, the coil energy is dissipated and there is no current flow in the primary circuit.

Figure 3:
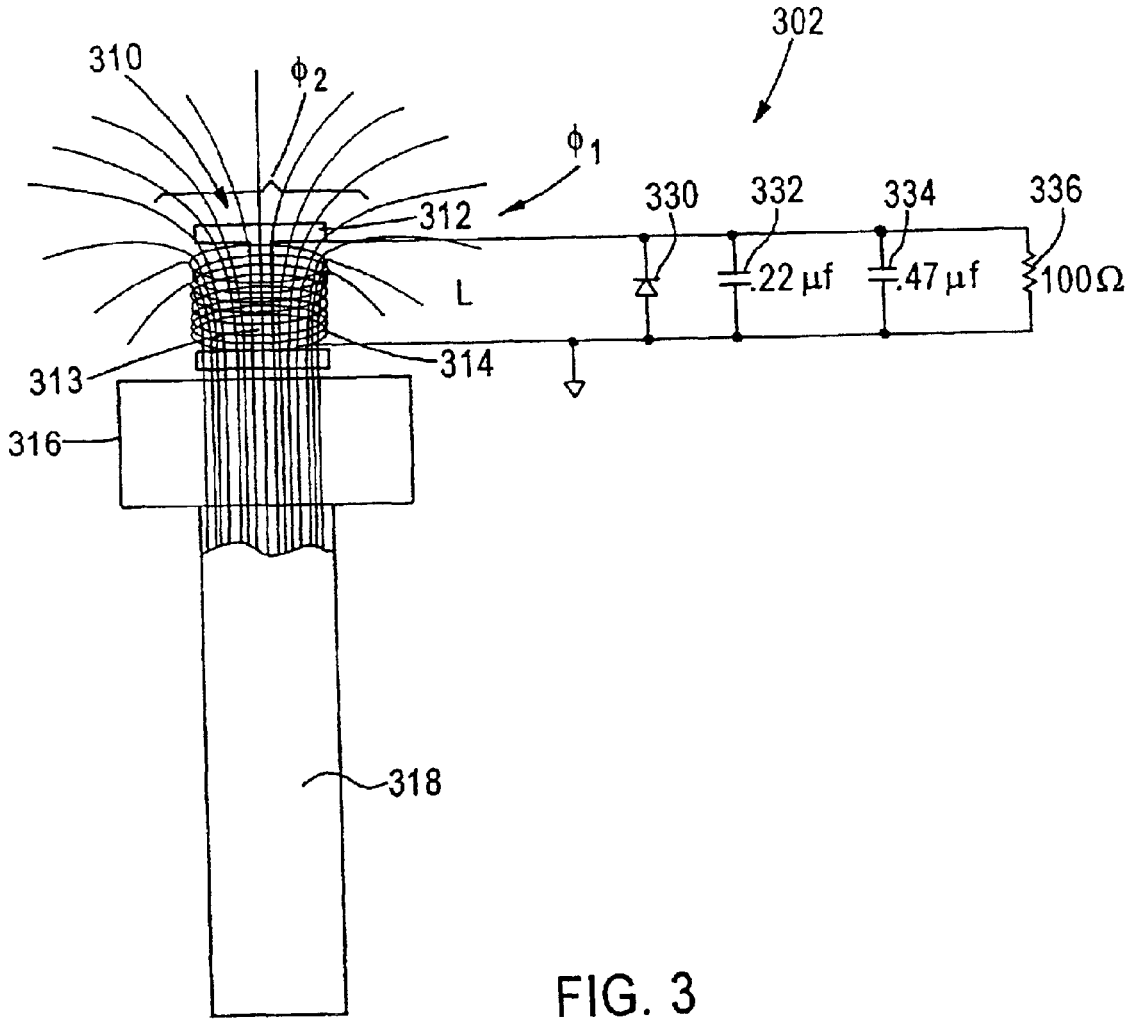
FIG. 3 shows an inductive sensor and coil-on plug testing apparatus in accord with the invention wherein diode polarity is shown for positive going output.

FIG. 3 illustrates a coil-on plug testing apparatus for generating an output signal indicative of characteristics of an ignition signal generated by a coil-on plug device, comprising an inductive sensor for detecting the ignition signal, means for attaching the inductive sensor to the coil-on plug device, and a signal processing circuit for generating an output signal in response to variations in an electromagnetic flux output by the coil-on plug device.

A coil-on-plug inductive sensor 310 is placed over the core 318 of the coil-on-plug coil, from which flux lines $\phi_1$ emanate. The flux lines $\phi_2$ passing through the inductive sensor 310, in turn, induce an emf $\epsilon$ (not shown) in the N turns (not shown) of the inductive sensor. This sampling of the flux $\phi_2$ emanating from the iron core of the coil-on-plug assembly by inductive sensor 310 may be used to determine a burn time of the spark plug. It is preferred that the inductive sensor 310 be placed in contact with or abutment against the housing of the coil-on plug to maximize the incident flux thereto.

A technician may simply hold an inductive sensor in place adjacent a coil on plug (COP) during the test. However, it is generally preferred to dispose the inductive sensor within a housing that may be positively attached to either the coil-on plug housing or an adjacent engine component or components to free-up the technicians hands and to minimize misalignment error. Positive attachment may be achieved by securement devices, such as but not limited to conventional clamps or ties (e.g., tie downs) configured to mate with or attach to portions of the coil-on plug housing, magnetic clips, or a threaded section, if available on the exterior of the coil-on plug housing. In one aspect, a biasing member, such as one or more springs or a foam insert, could be implemented to bias the inductive sensor 310 against the coil-on plug housing. Further, the inductive sensor housing could be configured to mate with specific coil-on plug housings. Still further, the inductive sensor housing could be configured with a plurality of separate inductive sensors to simultaneously mate with a corresponding plurality of coil-on plug housings. Moreover, inductive sensors may be integrated into the COP housing and connected, via the vehicle wiring harness and data links, to an on-board vehicle diagnostic data computer and/or data storage device, for subsequent use by a technician or for display of appropriate messages or signals to a vehicle operator.

The inductive sensor 310 preferably is an air core or open core inductor, such as "choke" type inductors conventionally designed for use as filters in switching type DC power supplies. Such inductors are incorporated into a casing or circuit board having a geometry suitable to facilitate proximal attachment to or placement adjacent a coil-on-plug for measurement. Closed core designs are generally not suitable for use in the invention because such conventional closed core designs substantially restrict magnetic flux to the core and do not readily permit external flux sampling, which is essential to the invention. FIG. 3 depicts an example wherein a bobbin 312 having a core 313 of length L about which a winding 314 having N-turns is disposed. Bobbin 312 may comprise a non-magnetic material (e.g., plastic, cardboard, ceramic, wood, etc.) serving simply to hold the shape of the coil 314 or may comprise an iron core or a ferrite core.

It is advantageous for the inductive sensor 310 to be selected to maximize inductance and self-resonant frequency, minimize coil resistance and size, and present a geometry that can be positioned on top of a coil-on-plug without significant interference with existing vehicle engine components. As known to those skilled in the art, the sensor 310 inductance may be adjusted to suit a specific application by changing the inductance factor (number of turns N), the coil diameter, the length of the coil, and the coil material. For example, the magnetic field leakage is proportional to the square of the number of turns N. Similarly, other components of the RLC circuit 302, shown for example in FIG. 3, may be adjusted in a manner known to those skilled in the art.

In FIG. 3, the inductive sensor 310 is disposed directly over a coil-on plug 316 (Chrysler P/N 56028138) such as is used in, for example, recent model years of the Jeep Grand Cherokee, Dakota, and Durango. RLC circuit 302, known to those skilled in the art, is adapted for the coil-on-plug configuration of the aforementioned Jeep coil-on plug 316 and is connected in parallel to the leads of inductive sensor 310. This RLC circuit advantageously includes a Schottky diode 330, capacitor 332, capacitor 334, and resistor 336, as shown, although capacitors 332, 334 could easily be replaced with a single capacitor in a manner known to those skilled in the art. Some or all of these components may be omitted.

Inductive sensor 310 or element L1 may be, for example, a 470 $\mu$H inductor, part number 03316 P-474, manufactured by Coilcraft of Cary, Ill. Schottky diode 330 may be a General Semiconductor surface-mount Schottky rectifier DO-219 (SMF) SL02 having a maximum average forward rectified current of 1.1 A, a maximum peak voltage of 20V, and a maximum instantaneous forward voltage $V_F$ of 0.385 V. Capacitors 332 and 334 may be 16V Panasonic ECPU film chip stacked film capacitors, part numbers ECPU1C224MA5 and ECPU1C474MA5, having respective capacitances of 0.22 $\mu$F and 0.47 $\mu$F and capacitance tolerances of ±20%. Resistor 336 may be a 100Ω Panasonic thick film chip resistor, part number ERJ3GEYJ101V, having a 70° C. power rating of 0.125 W and a resistance tolerance of ±5%. Addition of resistor 336 advantageously lowers the Q factor or the circuit in a manner known to those skilled in the art.

Figure 1A:
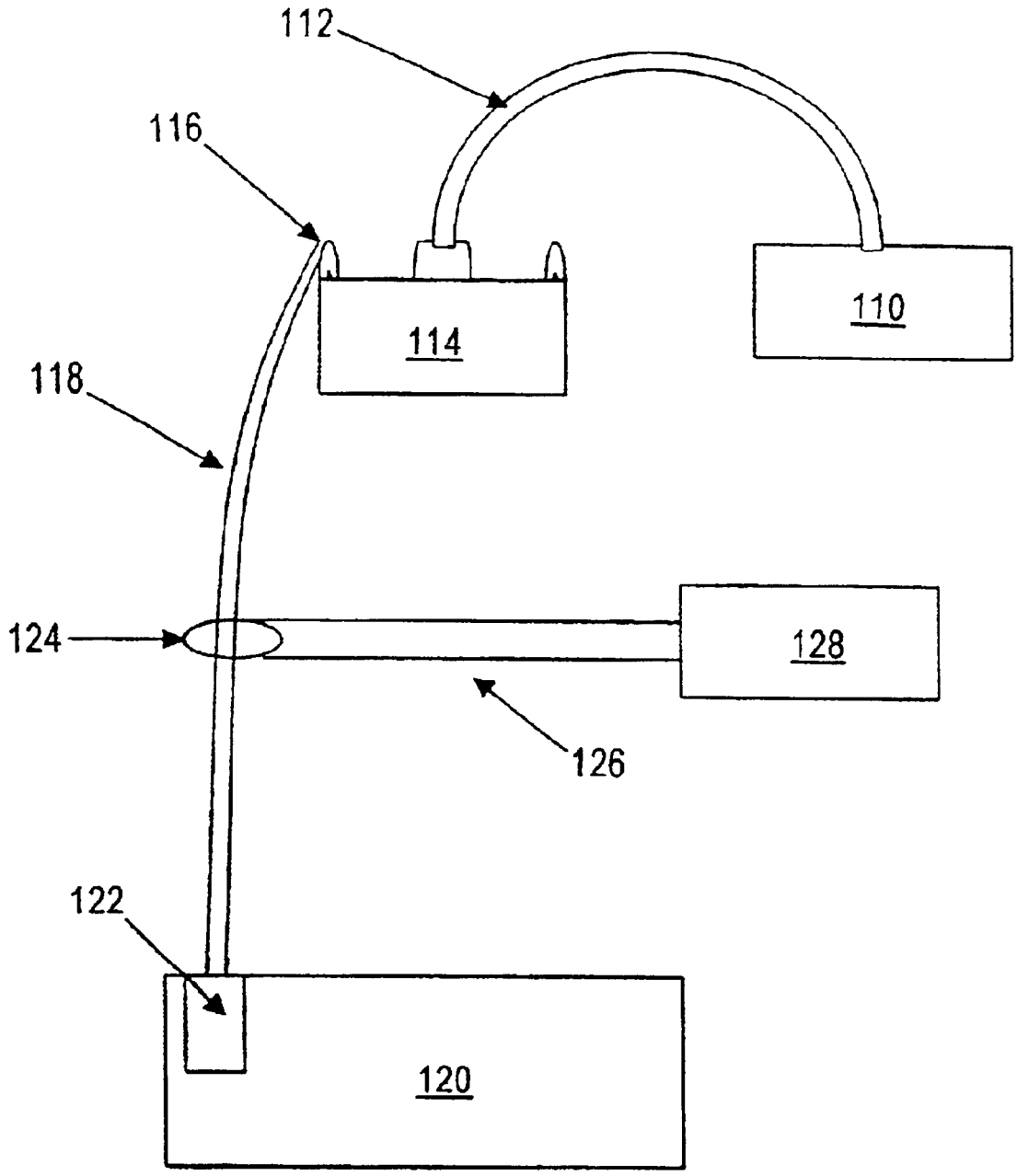
FIG. 1A (PRIOR ART)
FIG. 1*a* depicts a conventional capacitive sensor and circuit for detecting secondary ignition voltages of a distributor-based ignition system.
Figure 1B:
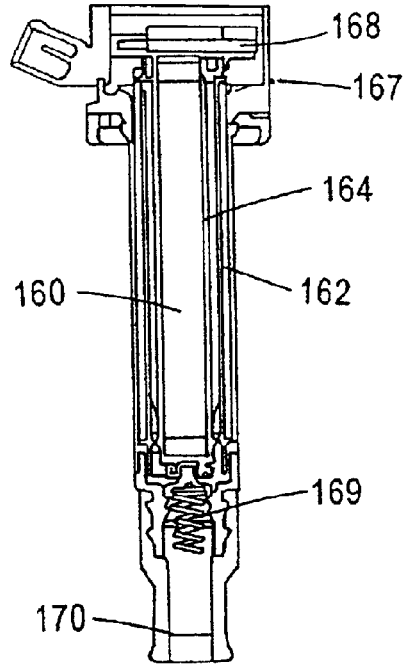
FIG. 1*b* shows a COP ignition coil with integrated igniter.
Figure 1C:
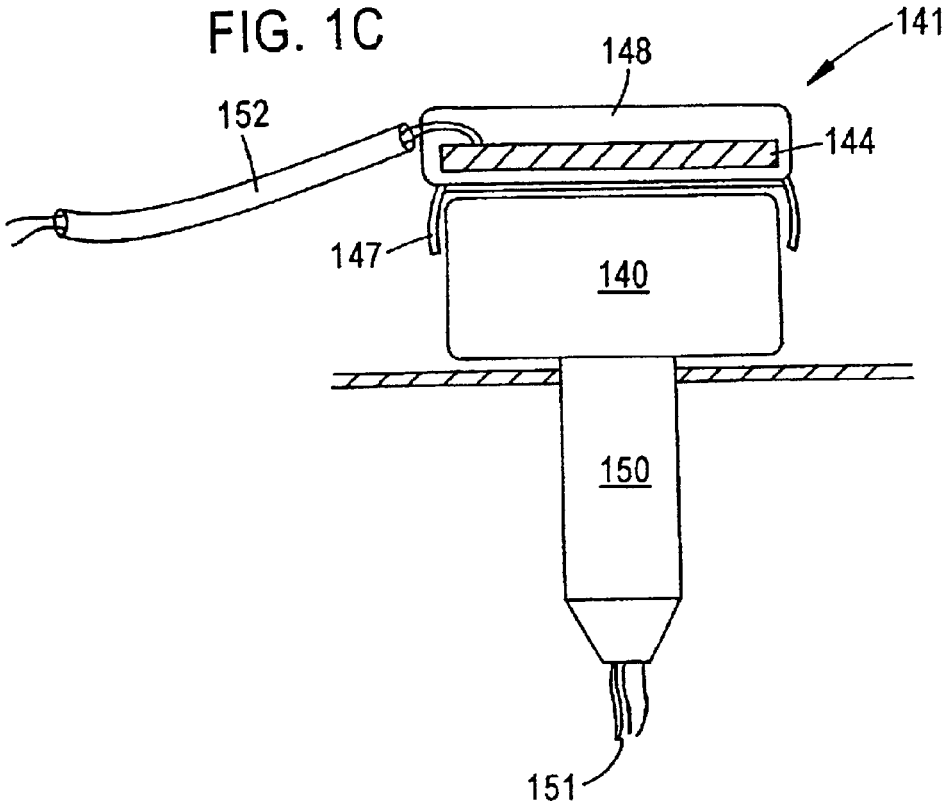
FIG. 1*c* shows another type of COP capacitive sensor placed adjacent a COP.

RLC circuit 302 is adapted for the coil-on-plug 316 used, for example, in the Jeep models noted above, which is a non-shielded configuration. In other words, unlike the coil-on plug shown in FIG. 1*d*, coil-on plug 316 does not have an igniter on top of the coil-on plug. Instead, the coil-on plug 316 igniter (not shown) is externally disposed and the igniter shielding does not attenuate the flux emanating from the core 318 of the coil-on plug 316. However, the flux emanating is of a low absolute value, which is unsuitable for a capacitive type sensor.

Figure 4A:
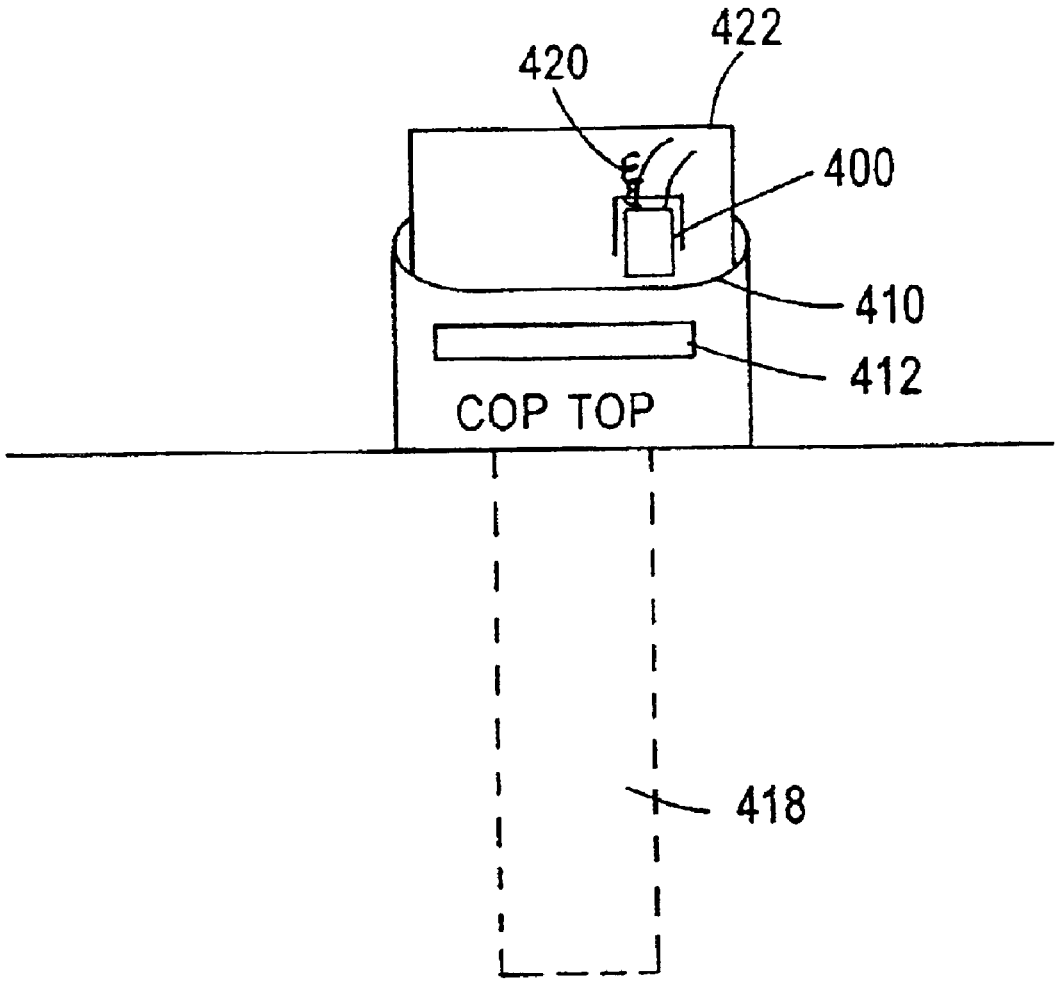
FIGS. 4*a*–4*b* respectively depict an inductive sensor disposed directly over a coil-on plug and an RLC circuit usable therewith.

FIG. 4*a* depicts an inductive sensor 400 disposed directly over a coil-on plug 410 such as is currently used in some Toyota™ engines. An RLC circuit (not shown) is connected in parallel to the leads (not shown) of the inductive sensor. Unlike the non-shielded configuration of the Jeep coil-on plug, shown in FIG. 3, the Toyota coil-on plug, shown in more detail in FIG. 1*d*, has an igniter comprising a shielding element 412 disposed on top of the coil-on plug. Shielding element 412 attenuates the flux emanating from the core 418 of the coil-on plug 410. Since the output flux is attenuated, it is advantageous to ensure a close contact between the inductor and the top of the coil-on plug and/or to employ two or more sensors wired in cascade. The inductive sensor 400 may be disposed within a casing 422 comprising a biasing element 420, such as a spring, to bias the inductive sensor 400 into intimate contact with the top surface of the coil-on plug 410. Alternatively, clamps or adhesive elements could also be used to improve contact between the inductive sensor and the coil-on plug housing.

Figure 4B:
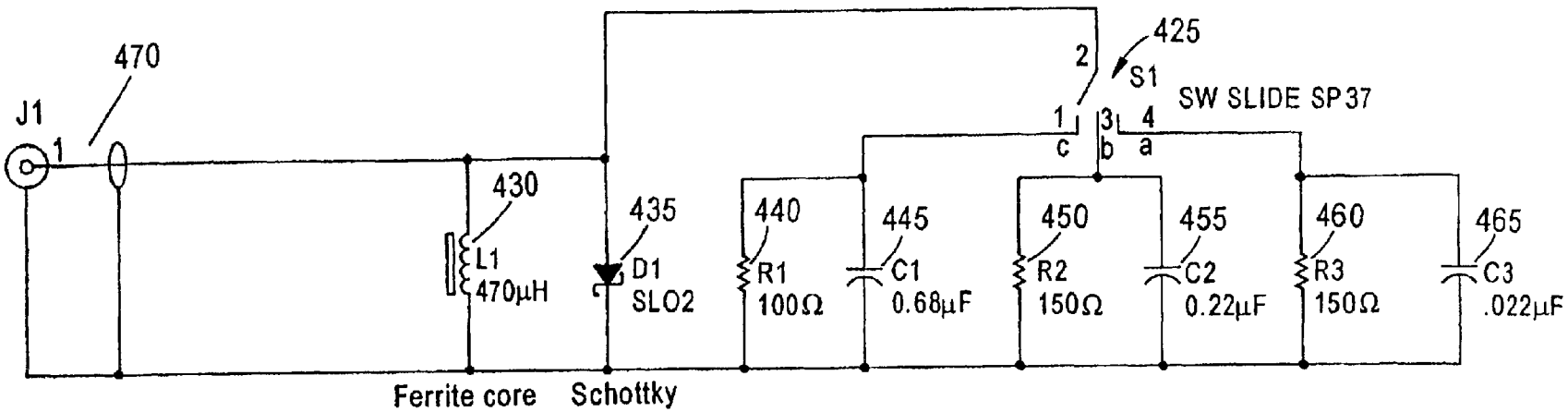

FIG. 4B shows one embodiment of the RLC circuit 302 of FIG. 3 in greater detail. This circuit is particularly adapted to a range of Toyota vehicles, which include the coil-on plug depicted in FIGS. 1*d* and 4A.

Switch 425 is, as one example, a C&K Switch Products OS series 3-position miniature slide switch (model number OS103011MS8OP1-SP3T). This 3-position switch has positions a, b, and c, as indicated, corresponding to three prongs of an RLC circuit. Digital switches having one or more on/off states may also be advantageously used. The leftmost prong c corresponds to Toyota coil-on-plug configurations 90919-02237 and 90080-19015, found on the 2000 Toyota Tacoma (CA spec) and 2000 Toyota Avalon, respectively. The middle prong b corresponds to Toyota coil-on-plug configurations 90919-02230 (Lo Top), 90919-02238, 90919-02239, and 90919-02240, found on the 2000 Toyota Tundra truck, 2000 Toyota Celica GTS, 2000 Toyota Celica, and 2000 Toyota Echo, respectively. Lastly, rightmost prong c corresponds to Toyota coil-on-plug configuration 90919-02230 (Hi Top), also found on the 2000 Toyota Tundra. It is to be understood that this is an exemplary, non-exhaustive list.

In this switchable configuration, an inductive sensor can be wedded to a plurality of selectable circuits to permit a technician to use a single sensor or sensing unit across a broad range of vehicles within a family of vehicles, such as Toyota vehicles, or across a broad range of engine types, such as shielded or non-shielded coil-on-plug architectures. Further, a plurality of circuits may be multiplexed to a plurality of inductive sensors to permit an even greater range of applicability within a single package.

Inductive sensor 310 is shown as element 430, a 470 $\mu$H inductor. One suitable inductor is a 6000 series radial lead RF choke manufactured by J. W. Miller Magnetics of Gardenia, Calif., such as the 6000-471K, a ferrite core, 471 $\mu$H, 1.1Ω inductor. Schottky diode 435 may be a General Semiconductor small surface-mount Schottky rectifier DO-219 (SMF) SL02 having a maximum average forward rectified current of 1.1 A, a maximum peak voltage of 20V, and a maximum instantaneous forward voltage $V_F$ of 0.385 V.

Capacitors 445 and 455 may be 16V Panasonic ECPU film chip stacked film capacitors, part numbers ECPU1C684MA5 and ECPU1C224MA5, having respective capacitances of 0.68 $\mu$F and 0.22 $\mu$F and capacitance tolerances of ±20%. Capacitor 465 may be a 16V Panasonic ECHU(B) film chip stacked film capacitor, part number ECHU1C223JB5 having a capacitance of 0.022 $\mu$F and capacitance tolerances of ±5%.

Resistor 440 may be a 100Ω Panasonic thick film chip resistor, part number ERJ3GEYJ101V, having a 70° C. power rating of 0.125 W and a resistance tolerance of ±5%. Resistors 450 and 460 may be 150Ω Panasonic thick film chip resistor, part number ERJ3GEYJ151V, also having a 70° C. power rating of 0.125 W and a resistance tolerance of ±5%. Cable 470 is a Snap-On Diagnostics™ Pigtail coil-on-plug board, part number 3683-01 having a female phono connector. The output of the circuit may be supplied to a Vantage-kV Module input, although any conventional engine analyzer or waveform display device, such as an oscilloscope, could be used when a suitable shunt capacitor is included. The kV Module input impedance is the bottom half of, for example, a 10,000:1 capacitive divider and presents primarily a capacitive reactance to the inductive sensor and circuit output.

Although the above circuits are described in relation to particular manufacturers and automobile models, the actual circuits relate more particularly to specific coil types and geometries. Thus, the teachings herein are not limited to providing diagnostic information for particular makes and models, or even of specific vehicle types, but of providing useful diagnostic information for coil-on plug systems used in any engine or vehicle type.

The implementation is by no means limited to the above described circuits, but comprises, broadly, any circuit able to output a voltage produced by the inductive sensor (e.g. 310) in a form suitable for identification, whether by a technician or by a processing device (i.e., a computer), of a firing line and an endpoint of a spark line to permit determination of a burn time by comparing or integrating the time between the firing line and the endpoint of the spark line. In various forms, the implementation may comprise a circuit having "universal" components wherein a single circuit is adaptable for use with a large number (e.g., 100 or more) of different coil-on plugs. For example, such a circuit could advantageously comprise a single resistor that could cover individually, or in combination with a potentiometer, a desired single resistance or range of resistances encompassing the large number of different coil-on plug designs. Such circuit could also comprise a variable inductor, such as but not limited to a screw or threaded core or cup core inductor, to permit a single inductor to similarly encompass the large number of different coil-on plug designs. To the extent desirable or necessary, a circuit herein may comprise a plurality of "semi-universal" circuits with appropriate selection means, wherein a plurality of variable circuits are provided to cover a plurality of ranges which, together, encompass an entire range of coil-on plug designs. In addition, a suitable capacitor may optionally be included.

Additionally, the above circuits are adapted for use with the exemplary coils and configurations discussed above. If additional shielding is present, or if the other configurations of the coil-on plug further diminish the available flux, additional circuit elements such as amplifiers or signal processors could be implemented in the circuit in accord with the invention.

Figure 5A:
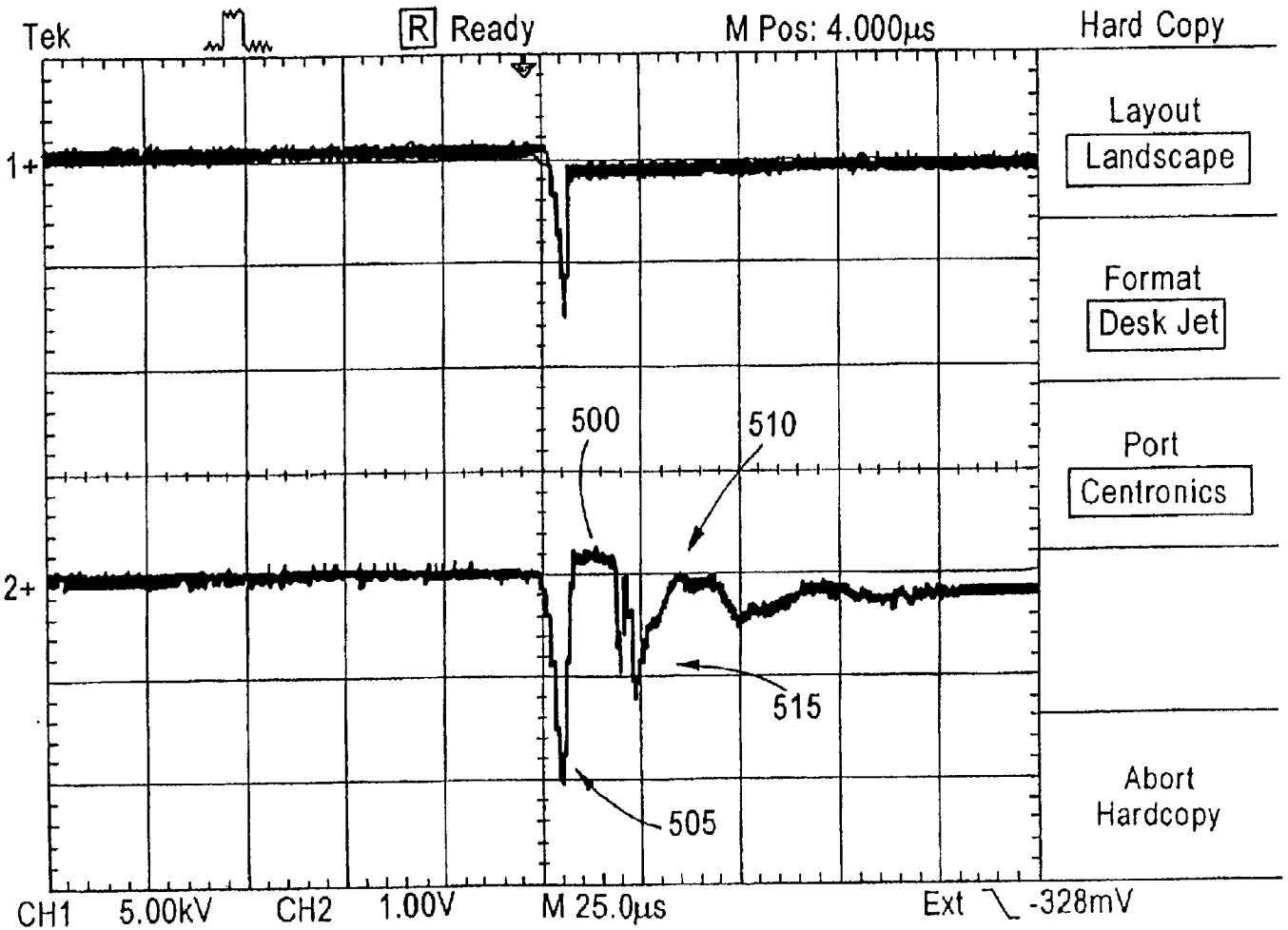
FIG. 5*a* is a waveform measured by a coil-on plug inductive sensor coupled to a display and a first circuit.

As an illustration of the operation of the inductive sensor and circuit as shown in FIG. 3, is now described with reference to FIGS. 5*a*–5*b*. FIG. 5*a* shows the voltage across the inductive sensor 310 as measured using a bench test setup. The upper curve labeled channel 1 is a voltage output from Tek (Tektronix) P6015 1000:1 HV probes connected to the coil-on plug secondary. The voltage is displayed on a Tek TDS 220 oscilloscope. As shown, the scale of channel 1 is 5.00 kV. The lower curve, labeled channel 2, is the voltage measured by the inductive sensor 310. The scale of channel 2 is 1.00V. As shown at the bottom of the FIG. 5*a*, each block represents an increment of 25.0 $\mu$s. FIG. 5*a* shows a magnified scale of negative spikes 505 and 515, which represent the equivalent firing line derived from magnetic flux and therefore current. The first spike 505 occurs coincident with firing and collapse of the primary field. The second spike 515 occurs about 20 microseconds later, due to a time delay in the RLC circuit, and is proportional to the firing line voltage. Although the voltage spikes are depicted as negative, this is arbitrary and the voltage can also be configured to read positively through, for example, an absolute value circuit known to those skilled in the art, or simply by reversing the leads of the inductive sensor.

Figure 5B:
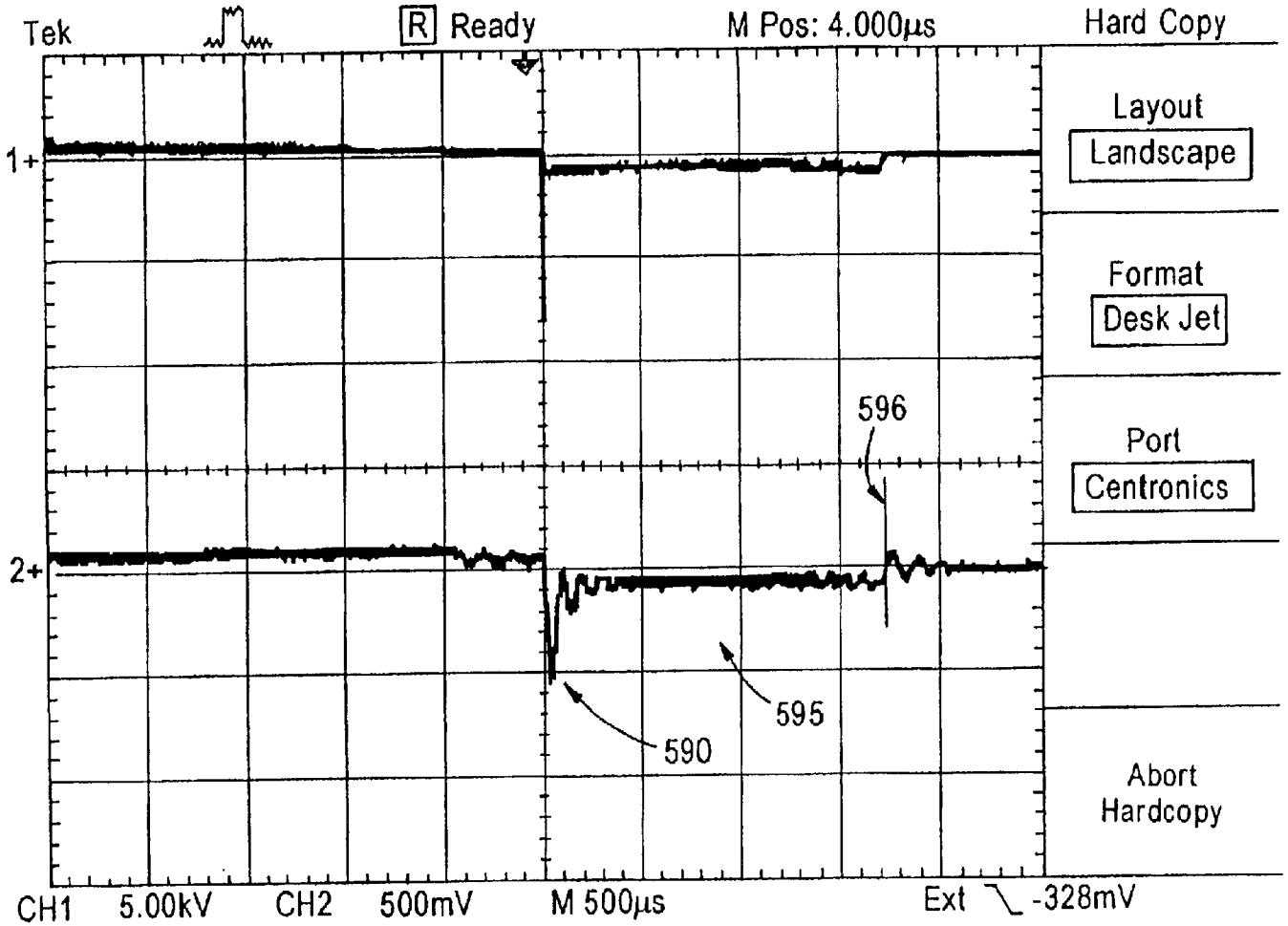
FIG. 5*b* is a waveform measured by a coil-on plug inductive sensor coupled to a display and a second circuit.

FIG. 5*b* shows, on a different scale, the waveform produced by RLC circuit 302. Channel 1 is the actual firing line voltage scaled at 5.00 kV and channel 2 is the firing line voltage measured using inductive sensor 310 scaled at 500 mV. As depicted, each block represents an increment of 500 μs. This expanded view shows the complete firing line, event 590, as well as the spark line 595 and the end of burn time 596. FIG. 5*b* shows that the burn time may be extracted from the waveform based on observation of known behaviors of the coil-on plug system, described generally in relation to FIGS. 2*a* and 2*b*, in a manner known to those skilled in the art. Roughly speaking, the burn time may be determined by measuring the time from the firing line 590, an obvious event on the viewing or printing device attached to the inductive sensor 310, to the start of the oscillations or ringing occurring roughly one or more milliseconds later at which point the voltage crosses back over the zero voltage line, indicating collapse of the spark across the electrodes.

Although the magnitude of event 590 has not been found to be linearly proportional to the actual voltage of the firing line, it is proportional to the actual voltage of the firing line within a wide useful range for many COP coils. As the actual firing voltage increases, the amplitude of event 590 increases and the amplitude of event 590 decreases as the actual firing voltage decreases. However, in an inductive system, as the actual firing voltage tends to zero, the amplitude of event 590 does not go to zero. A firing voltage tending toward zero may be caused by a spark plug having little to no spark plug gap, wherein the shorted current or non-spark event is delivered to ground through the internal resistance of the spark plug, maintaining a flux from the core as a result of a current continuing to flow in the secondary windings of the coil. Thus, firing line 590 might be considered to provide both a measure of the firing line or a functional equivalent thereto.

FIGS. 6*a*–6*b* through 9*a*–9*b* show test results for the aforementioned bench test setups wherein both the actual voltage output from Tek (Tektronix) P6015 1000:1 HV probes connected to the coil-on plug and the voltage output from the inductive sensor 310 were measured and compared. The voltage output from the inductive sensor 310 was actually measured using two devices. The first device was a Snap-On Tools -kV module handheld tester, and the second device was an attached oscilloscope having a bandwidth and improved accuracy greater than those of the handheld tester. FIGS. 6*a*, 7*a*, 8*a*, and 9*a* show the firing line kV as a function of a number of turns in the adjustable gap opening used for testing purposes to permit variable separation of the spark gap. FIGS. 6*b*, 7*b*, 8*b*, and 9*b* show the burn time in ms as a function of the magnitude of the firing line.

Figure 6A:
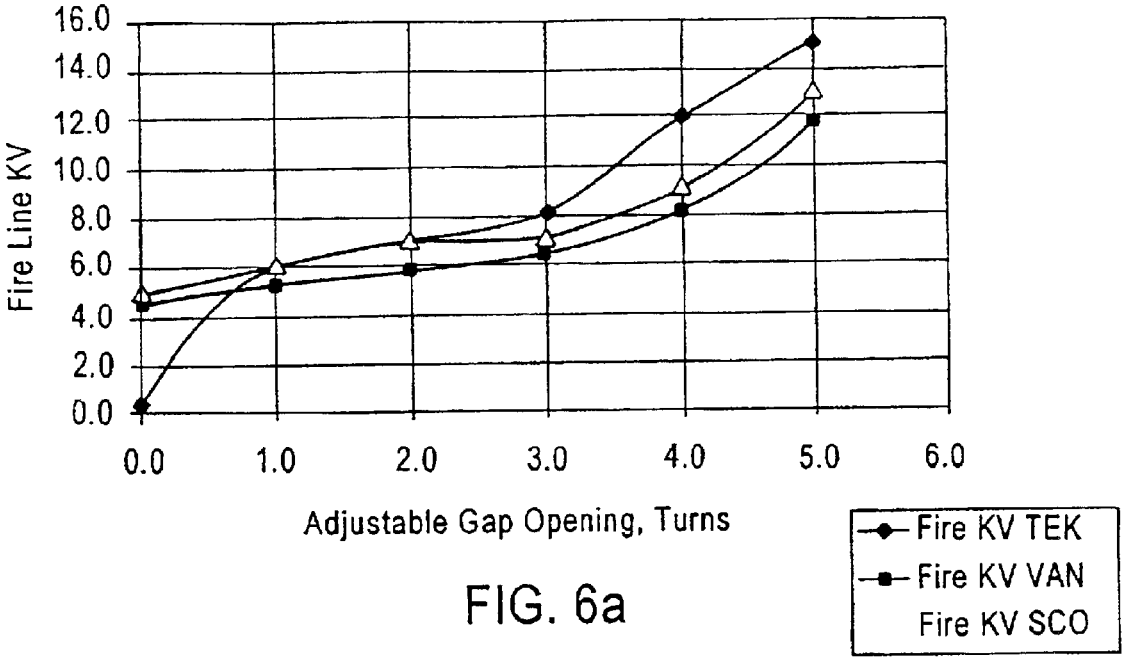
FIGS. 6*a*–6*b* show test results for a coil-on plug testing apparatus.
Figure 6B:
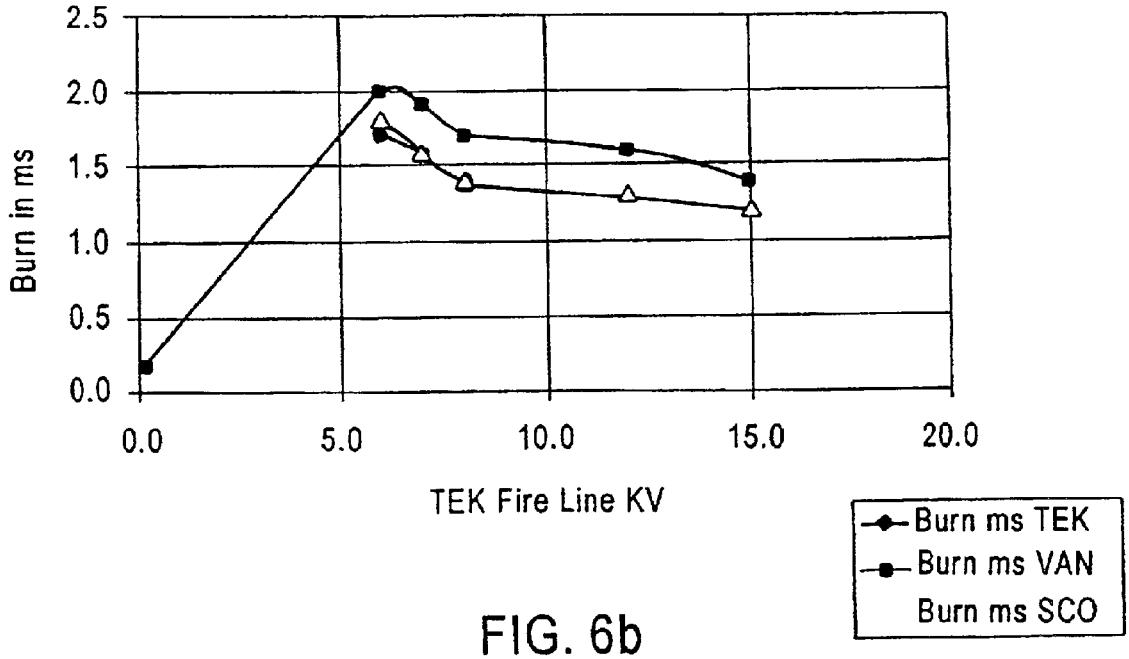

FIGS. 6*a* and 6*b* show a test of a Toyota coil-on plug, part number 90080-19015 using a circuit wherein 0.79 μF capacitor is connected in parallel with a 69Ω resistor and in parallel with a Miller 6000-471K inductor at a 14V DC battery voltage with a pulse repetition frequency (PRF) of 3 pulses per second (pps). In FIG. 6*a*, for each of gap turns 1.0, 2.0, 3.0, 4.0, and 5.0, the measured firing line voltages on the Tek probe was, respectively, 6.0, 7.0, 8.0, 12.0, and 15.0 V. The corresponding values for the handheld device were 5.2, 5.6, 6.4, 8.0, and 11.7 V. The corresponding values for the oscilloscope were 6.0, 7.0, 7.0, 9.0, and 13.0 V. In FIG. 6*b*, for each of gap turns 1.0, 2.0, 3.0, 4.0, and 5.0, and the aforementioned respective firing lines (kV), the measured burn time on the Tek probe was, respectively, 1.7, 1.6, 1.4, 1.3, and 1.2 ms. The corresponding values for the handheld device were 2.0, 1.9, 1.7, 1.6, and 1.4 ms. The corresponding values for the oscilloscope were 1.8, 1.6, 1.4, 1.3, and 1.2 ms.

Figure 7A:
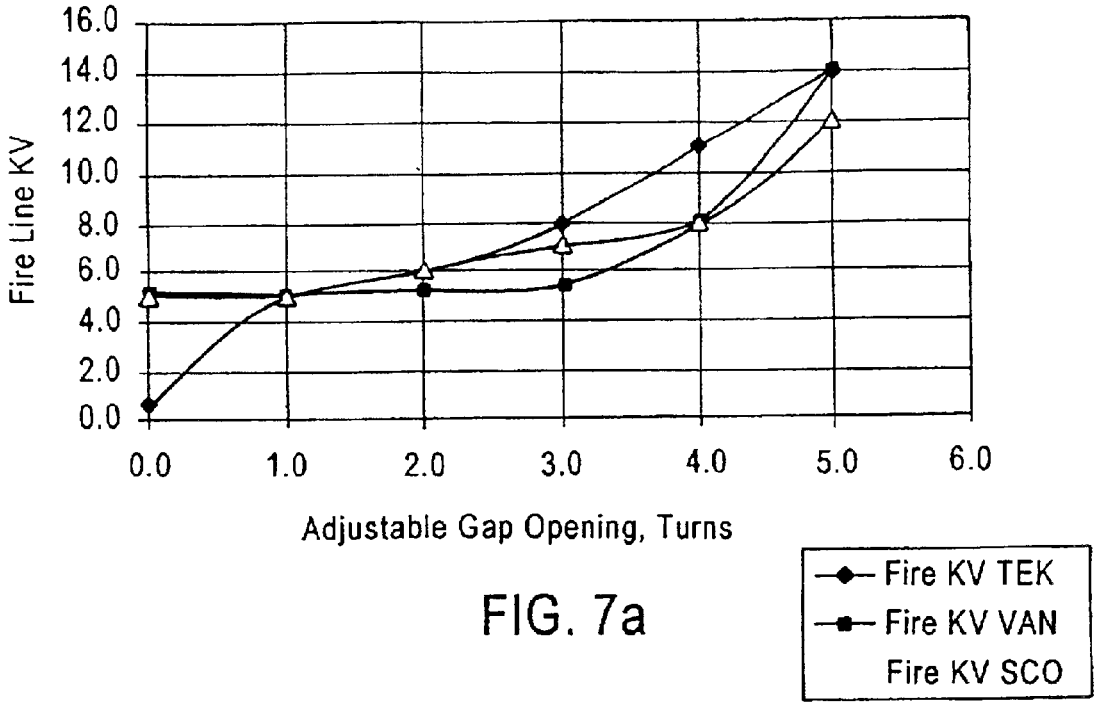
FIGS. 7*a*–7*b* show test results for another coil-on plug testing apparatus.
Figure 7B:
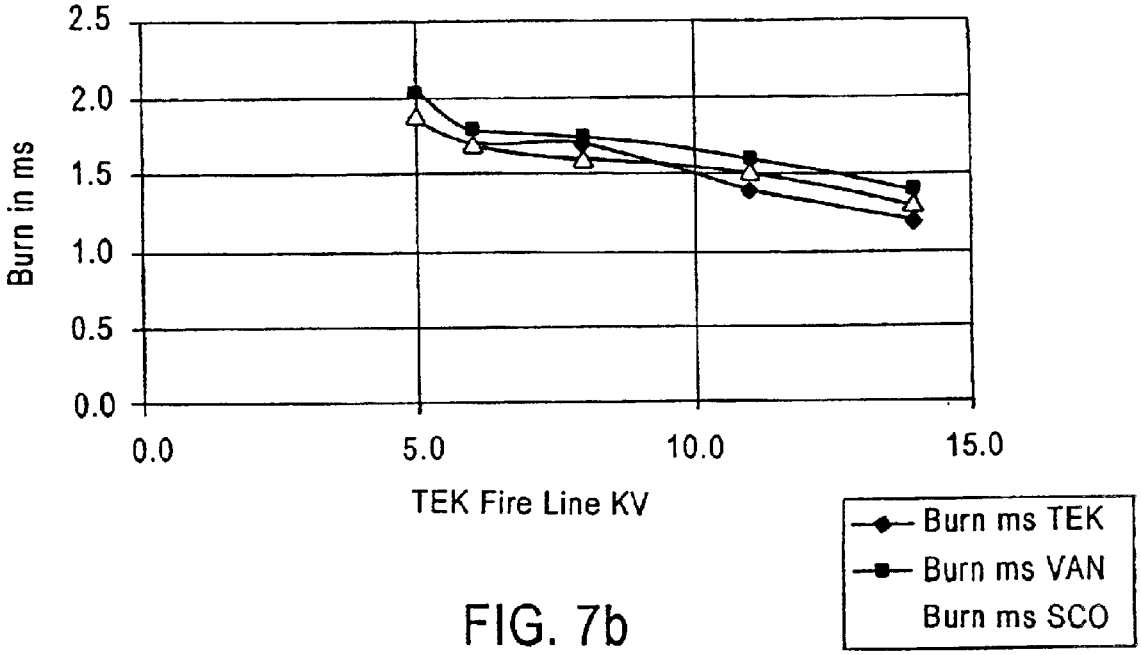

FIGS. 7*a* and 7*b* show a test of a Toyota coil-on plug, part number 90919-02239 using a circuit wherein 0.22 μF capacitor is connected in parallel with a 150Ω resistor and in parallel with a Miller 6000-471K inductor at a 14V DC battery voltage with a PRF of 3 pps. In FIG. 7*a*, for each of gap turns 1.0, 2.0, 3.0, 4.0, and 5.0, the measured firing line voltages on the Tek probe was, respectively, 5.0, 6.0, 8.0, 11.0, and 14.0 V. The corresponding values for the handheld device were 5.2, 5.2, 5.4, 8.2, and 13.9 V. The corresponding values for the oscilloscope were 5.0, 6.0, 7.0, 8.0, and 12.0 V. In FIG. 7*b*, for each of gap turns 1.0, 2.0, 3.0, 4.0, and 5.0, and the aforementioned respective firing lines (kV), the measured burn time on the Tek probe was, respectively, 1.9, 1.7, 1.7, 1.4, and 1.2 ms. The corresponding values for the handheld device were 2.1, 1.8, 1.8, 1.6, and 1.4 ms. The corresponding values for the oscilloscope were 1.9, 1.7, 1.6, 1.5, and 1.3 ms.

Figure 8A:
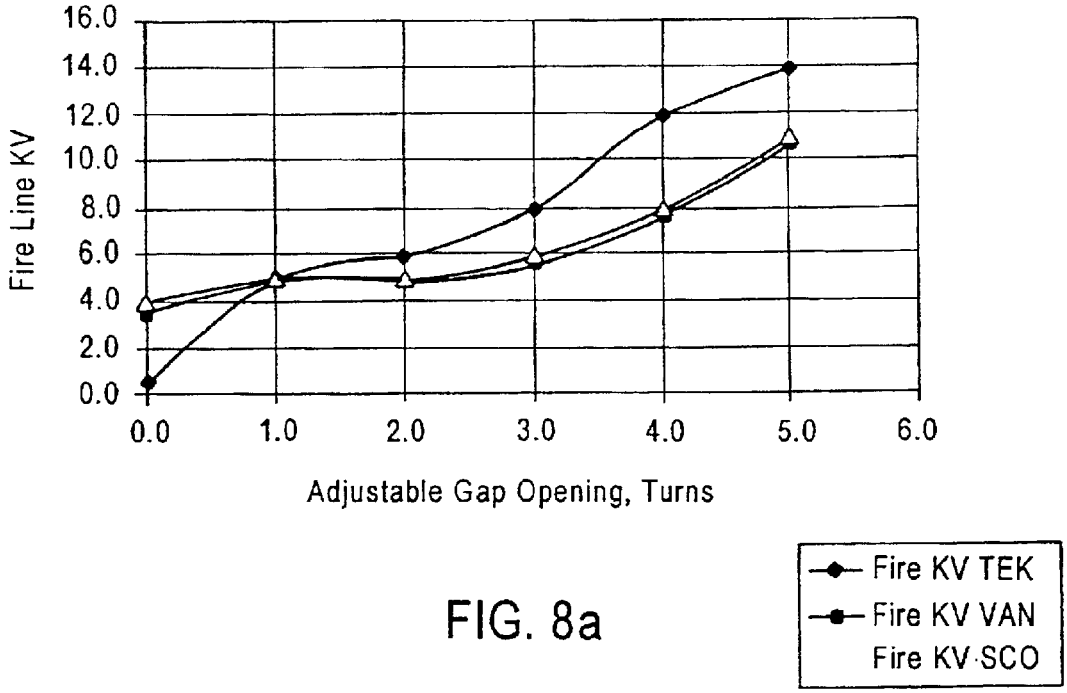
FIGS. 8*a*–8*b* show test results for still another coil-on plug testing apparatus.
Figure 8B:
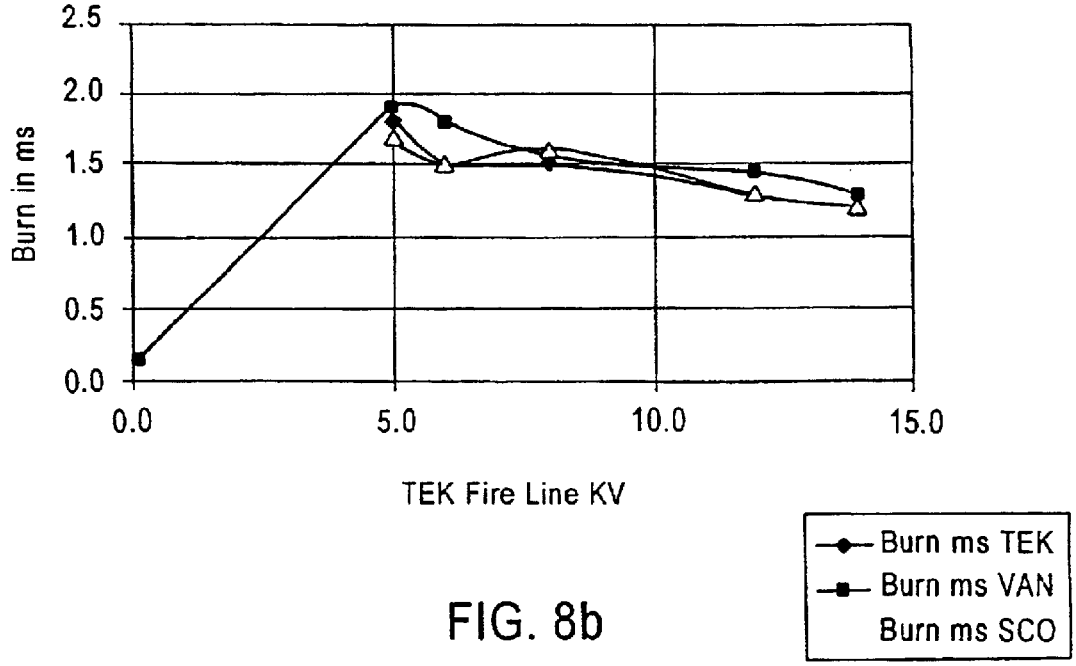

FIGS. 8*a* and 8*b* show a test of a Toyota coil-on plug, part number 90919-02237 using a circuit wherein 0.69 μF capacitor is connected in parallel with a 100 μ resistor and in parallel with a Miller 6000-471K inductor at a 14V DC battery voltage with a PRF of 3 pps. In FIG. 8*a*, for each of gap turns 1.0, 2.0, 3.0, 4.0, and 5.0, the measured firing line voltages on the Tek probe was, respectively, 5.0, 6.0, 8.0, 12.0, and 14.0 V. The corresponding values for the handheld device were 4.4, 4.6, 5.6, 7.6, and 10.7 V. The corresponding values for the oscilloscope were 5.0, 5.0, 6.0, 8.0, and 11.0 V. In FIG. 8*b*, for each of gap turns 1.0, 2.0, 3.0, 4.0, and 5.0, and the aforementioned respective firing lines (kV), the measured burn time on the Tek probe was, respectively, 1.8, 1.5, 1.5, 1.3, and 1.2 ms. The corresponding values for the handheld device were 1.9, 1.8, 1.6, 1.5, and 1.3 ms. The corresponding values for the oscilloscope were 1.7, 1.5, 1.6, 1.3, and 1.2 ms.

Figure 9A:
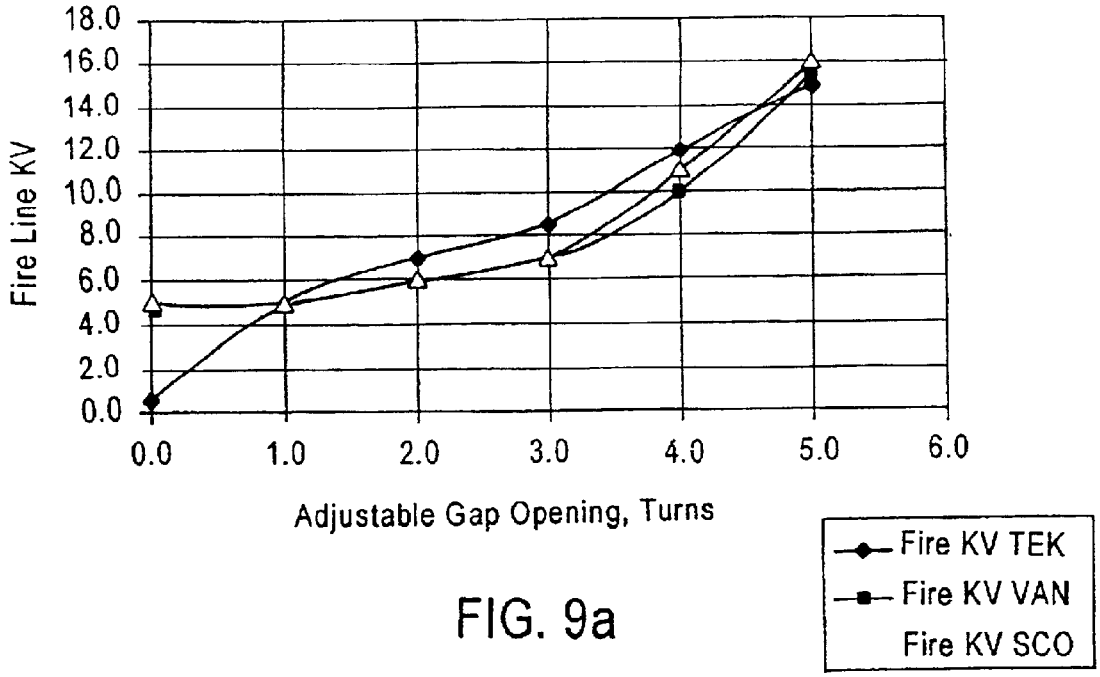
FIGS. 9*a*–9*b* show test results for yet another coil-on plug testing apparatus.
Figure 9B:
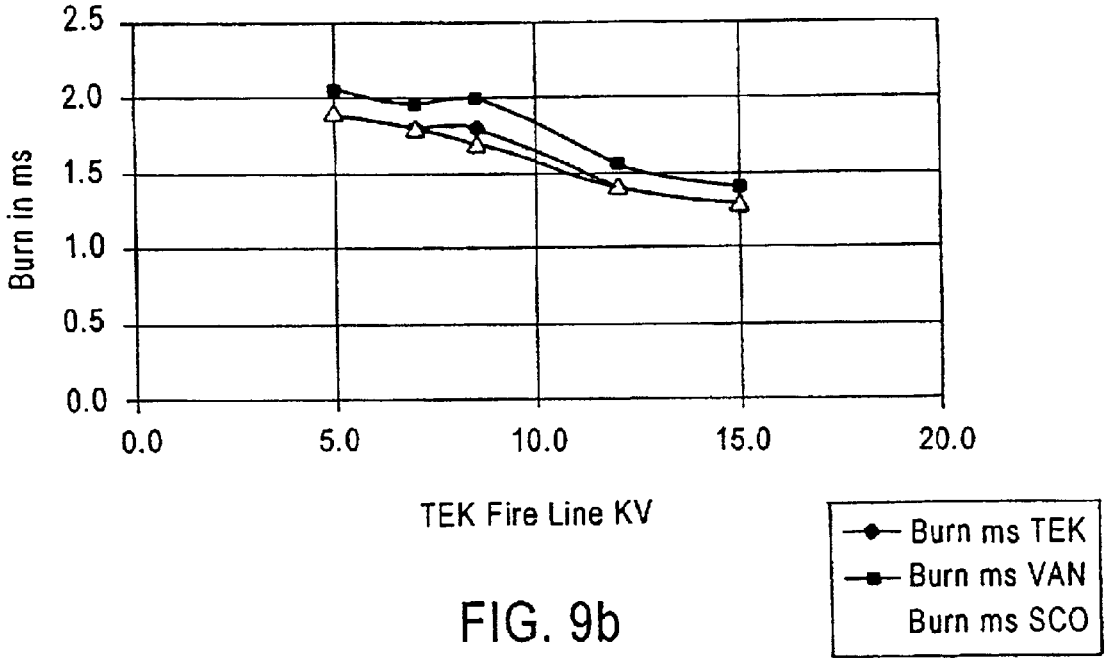

FIGS. 9*a* and 9*b* show a test of a Toyota coil-on plug, part number 90919-02238 using a circuit wherein 0.22 μF capacitor is connected in parallel with a 150Ω resistor and in parallel with a Miller 6000-471K inductor at a 14V DC battery voltage with a PRF of 3 pps. In FIG. 9*a*, for each of gap turns 1.0, 2.0, 3.0, 4.0, and 5.0, the measured firing line voltages on the Tek probe was, respectively, 5.0, 7.0, 8.5, 12.0, and 15.0 V. The corresponding values for the handheld device were 4.4, 4.6, 5.6, 7.6, and 10.7 V. The corresponding values for the oscilloscope were 5.0, 5.2, 7.0, 10.0 and 15.6 V. In FIG. 9*b*, for each of gap turns 1.0, 2.0, 3.0, 4.0, and 5.0, and the aforementioned respective firing lines (kV), the measured burn time on the Tek probe was, respectively, 1.9, 1.8, 1.8, 1.4, and 1.3 ms. The corresponding values for the handheld device were 2.1, 2.0, 2.0, 1.6, and 1.4 ms. The corresponding values for the oscilloscope were 1.9, 1.8, 1.7, 1.4, and 1.3 ms.

Figure 10A:
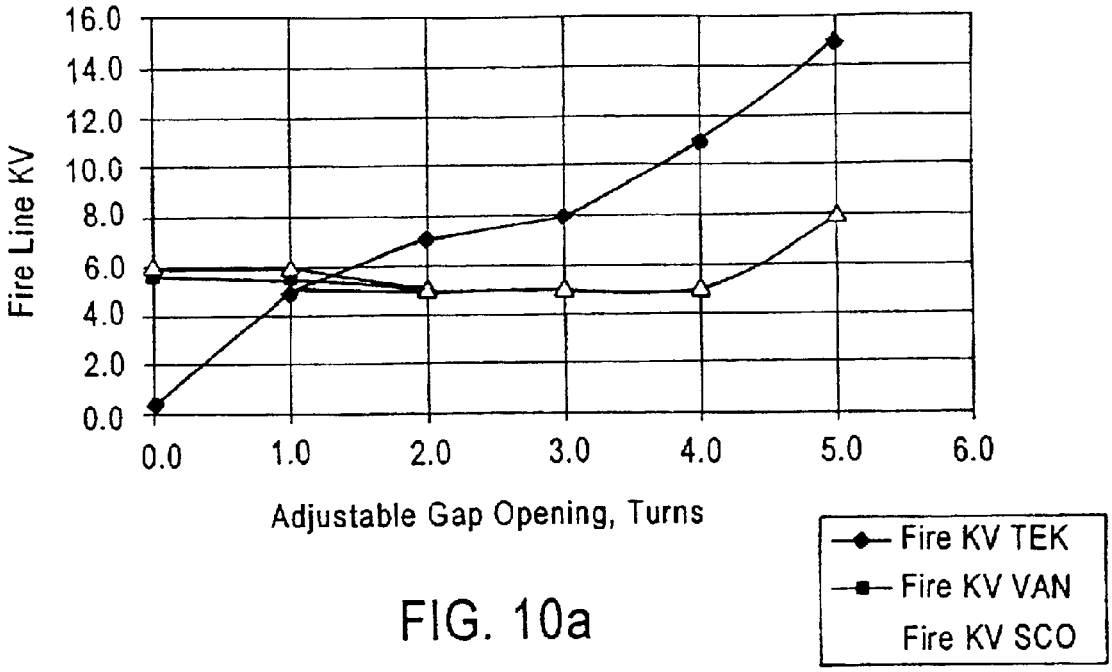
FIGS. 10*a*–10*b* show test results for another coil-on plug testing apparatus.
Figure 10B:
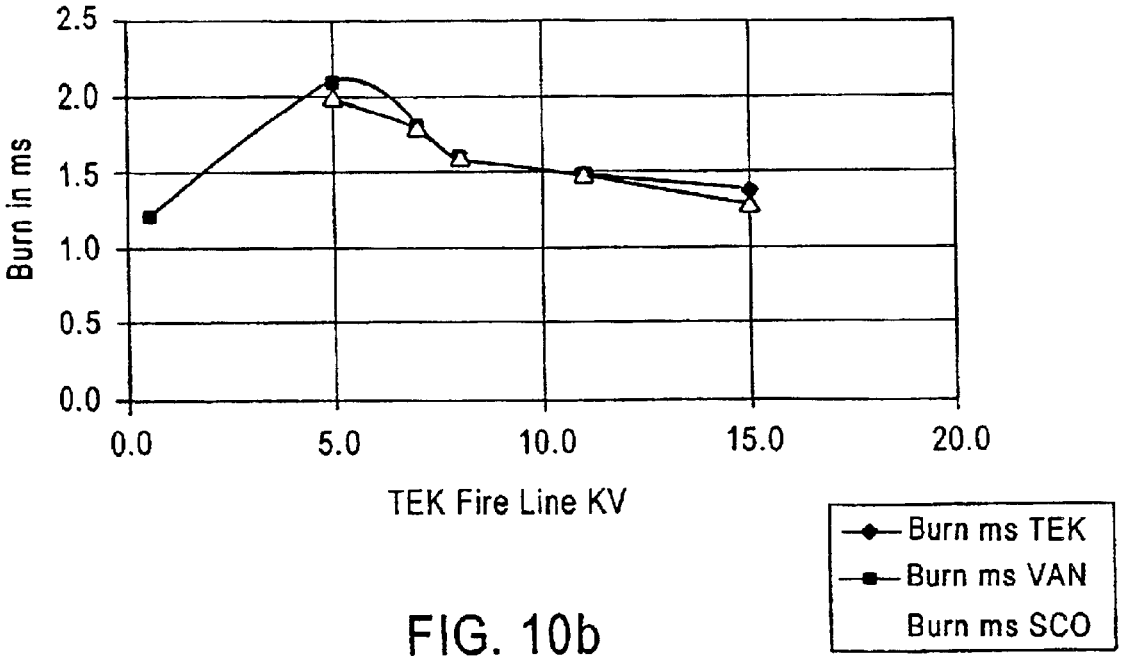

FIGS. 10*a* and 10*b* show a test of a Toyota coil-on plug, part number 90919-02230HI using a circuit wherein 0.12 μF capacitor is connected in parallel with a 220Ω resistor and in parallel with a Miller 6000-471K inductor at a 14V DC battery voltage with a PRF of 3 pps. As shown in FIG. 10*a*, for each of gap turns 1.0, 2.0, 3.0, 4.0, and 5.0, the measured firing line voltages on the Tek probe was, respectively, 5.0, 7.0, 8.0, 11.0, and 15.0 V. The corresponding values for the handheld device were 5.2, 5.0, 4.8, 5.0, and 8.0 V. The corresponding values for the oscilloscope were 6.0, 5.0, 5.0, 5.0 and 8.0 V. In FIG. 10*b*, for each of gap turns 1.0, 2.0, 2.0, 3.0, 4.0, and 5.0, and the aforementioned respective firing lines (kV), the measured burn time on the Tek probe was, respectively, 2.0, 1.8, 1.6, 1.5, and 1.4 ms. The corresponding values for the handheld device were 2.1, 1.8, 1.6, 1.5, and 1.3 ms. The corresponding values for the oscilloscope were 2.0, 1.8, 1.6, 1.5, and 1.3 ms. As evident from FIGS. 10*a* and 10*b*, the burntime was acceptably detected and ascertained. However, the firing line was not accurately reproduced. Accordingly, in this instance, a dual inductor design wherein two Miller 6000-471K inductors were wired for boost in a manner known to those skilled in the art, to effectively double the signal. A single 200Ω resistor was connected across the two-coil output to limit the ringing period. However, this value may be changed to suit particular COP's. This configuration was found to yield good results, as shown in FIGS. 11*a*–11*h*.

Figure 11A:
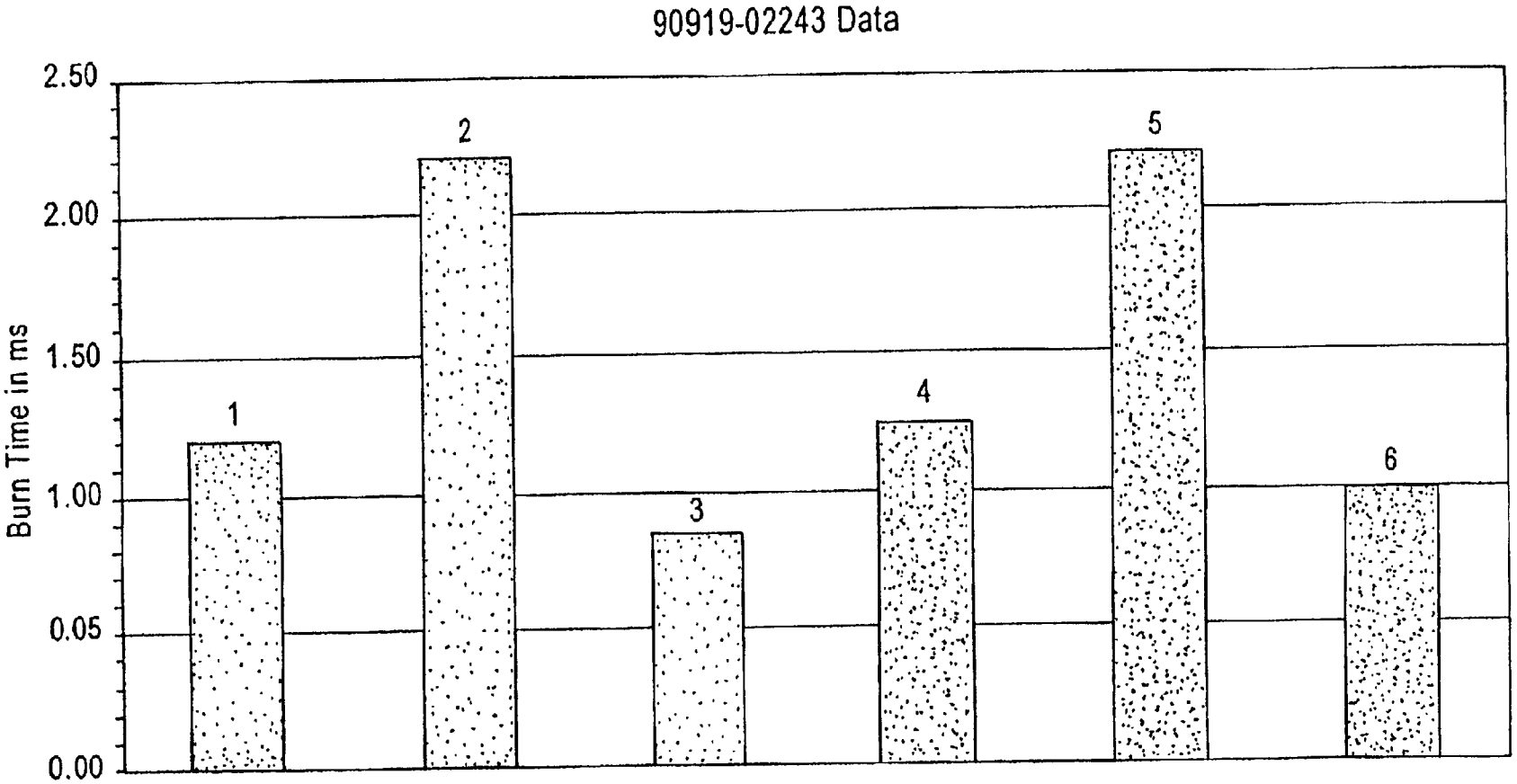
FIGS. 11*a*–11*h* show burn time test results for a dual inductor sensor configuration.

FIGS. 11*a*–11*h* show results for one aspect of a dual inductor sensor configuration. FIG. 11*a* relates to the 90919-02243 COP and shows, in the leftmost set of three vertical bars, the burn times (in milliseconds) as measured by an oscilloscope for a normal gap (1.2 ms), shorted gap (2.2 ms), and near open gap (0.85 ms), respectively. The rightmost set of three vertical bars likewise show the burn times, as measured by the handheld device, for a normal gap (1.25 ms), shorted gap (2.2 ms), and near open gap (1.0 ms), respectively. In this particular setup, the 200Ω shunt damping resistor was removed to provide a voltage from induction flux that consistently exceeded threshold for firing line so as to ensure display on the display. As shown in FIG. 11*a*, the oscilliscope and handheld device were significantly in agreement with respect to each of the normal gap (1, 4), shorted gap (2, 5), and near open gap (3, 6).

Figure 11B:
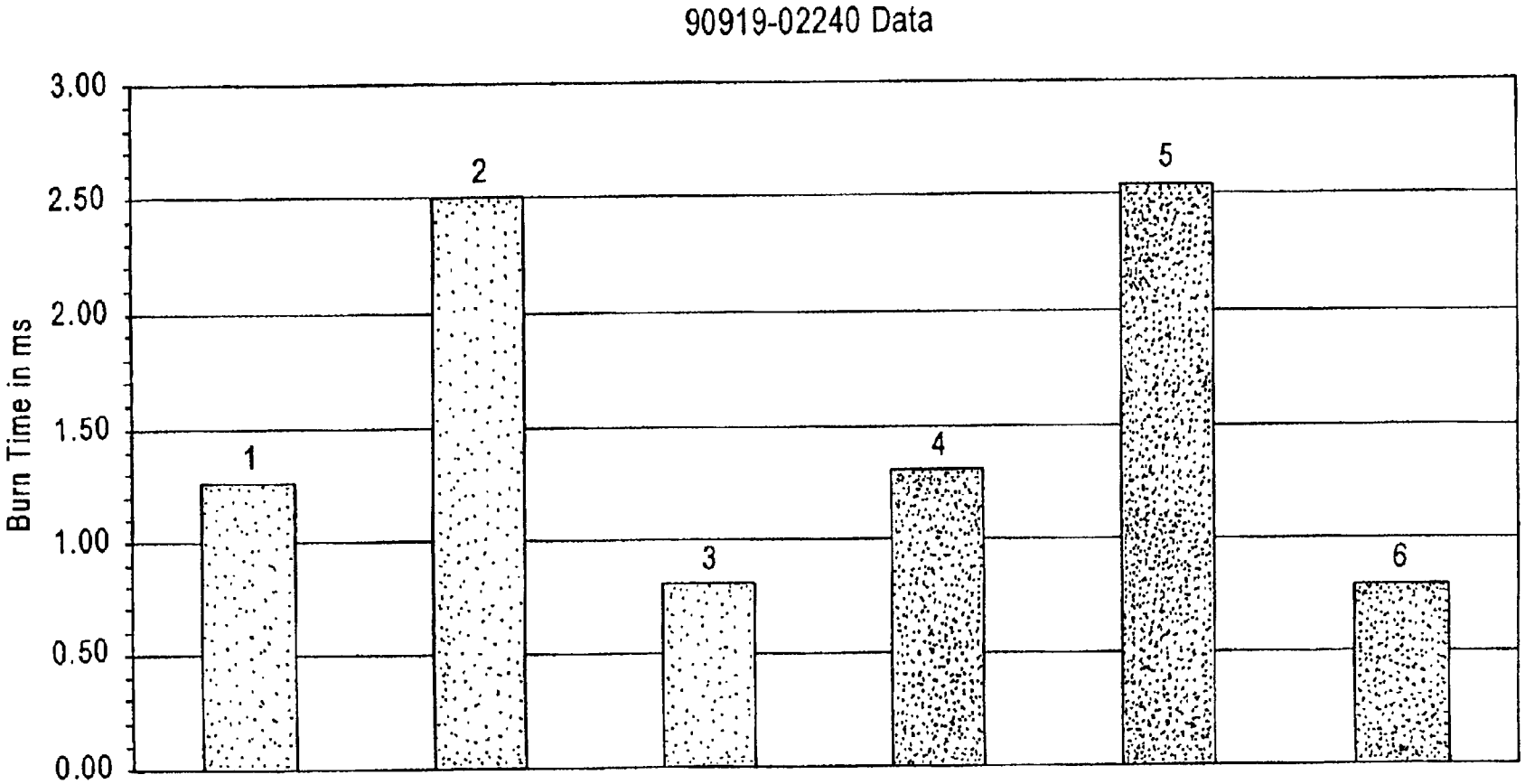
Figure 11C:
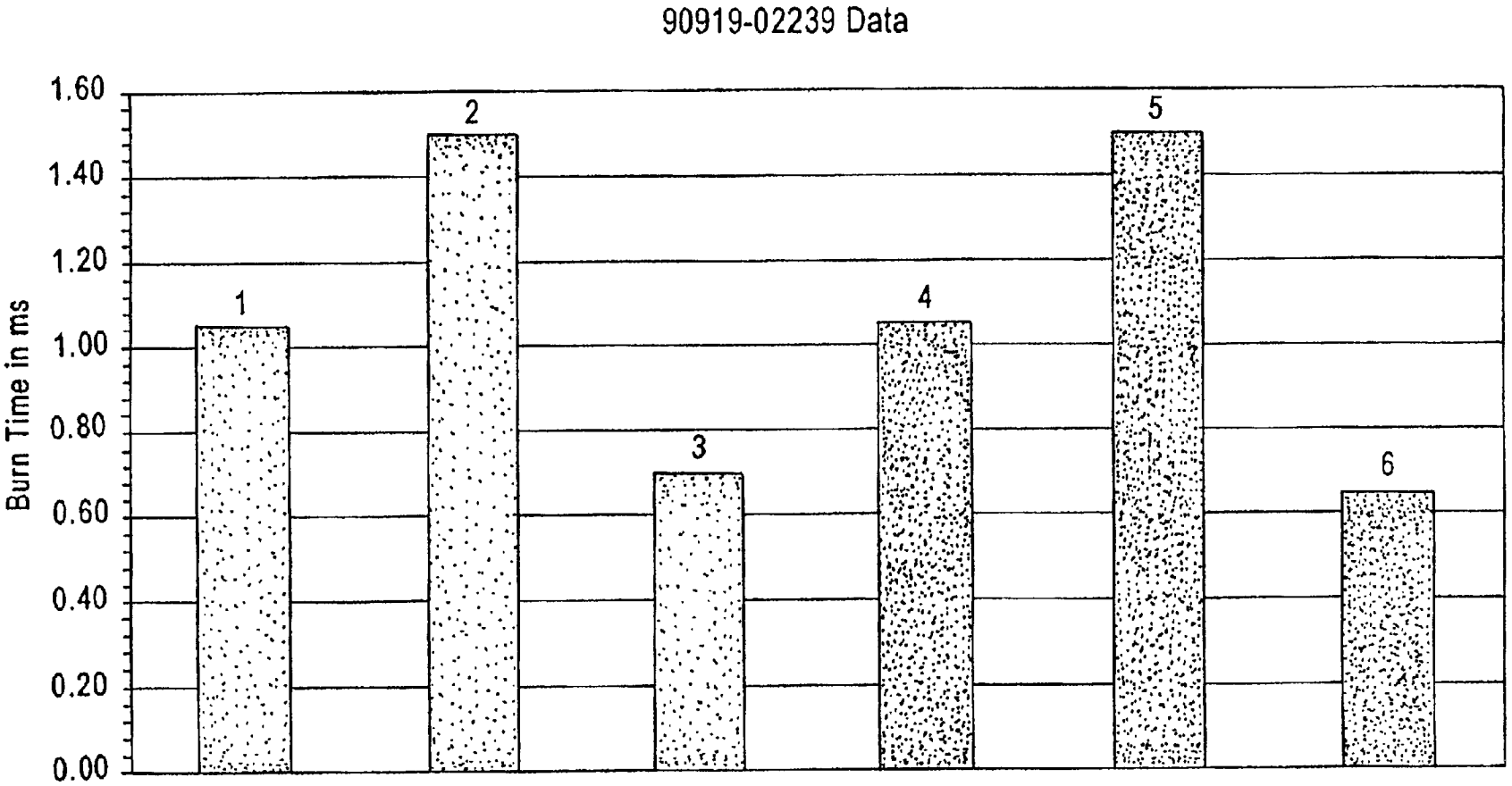
Figure 11D:
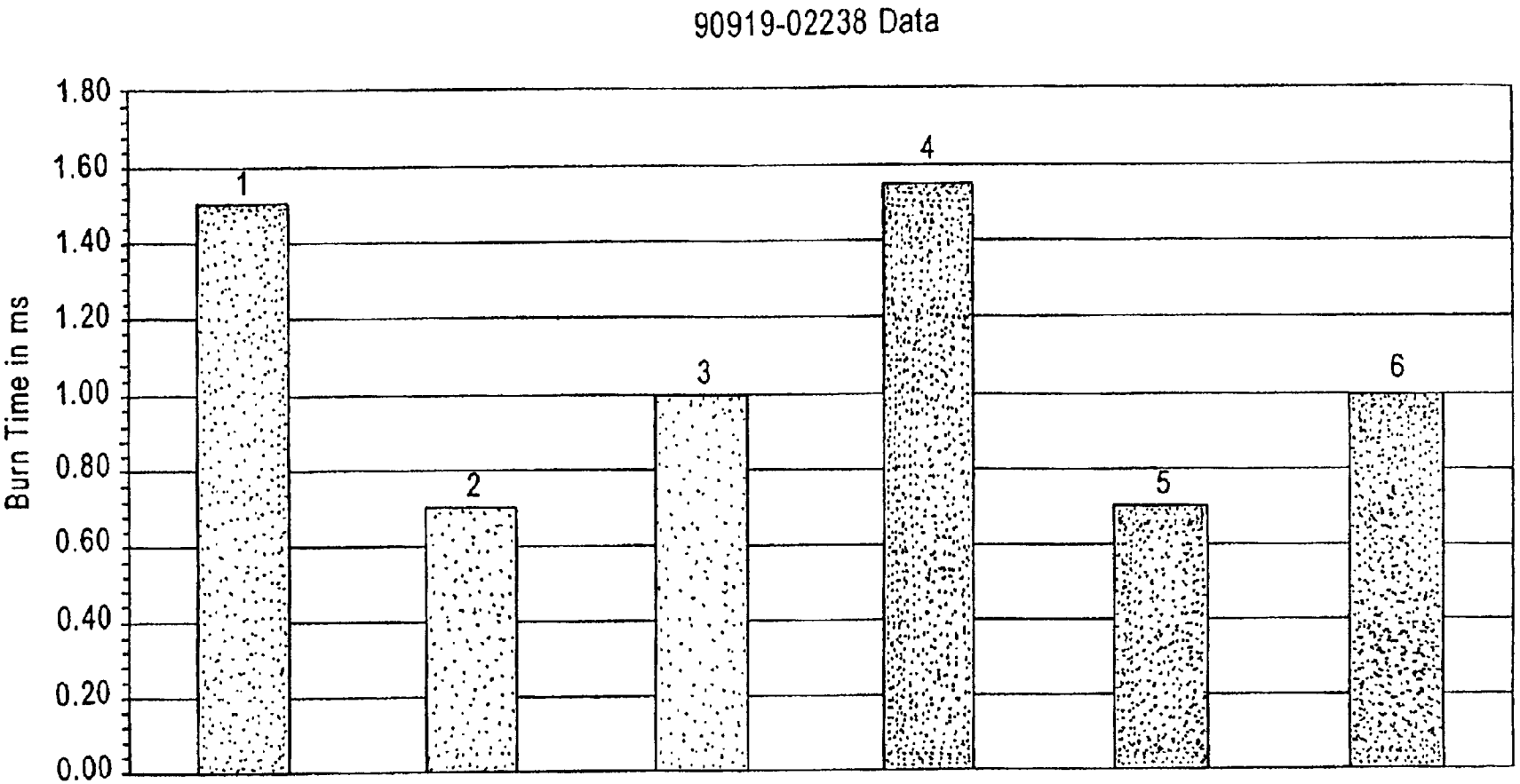
Figure 11E:
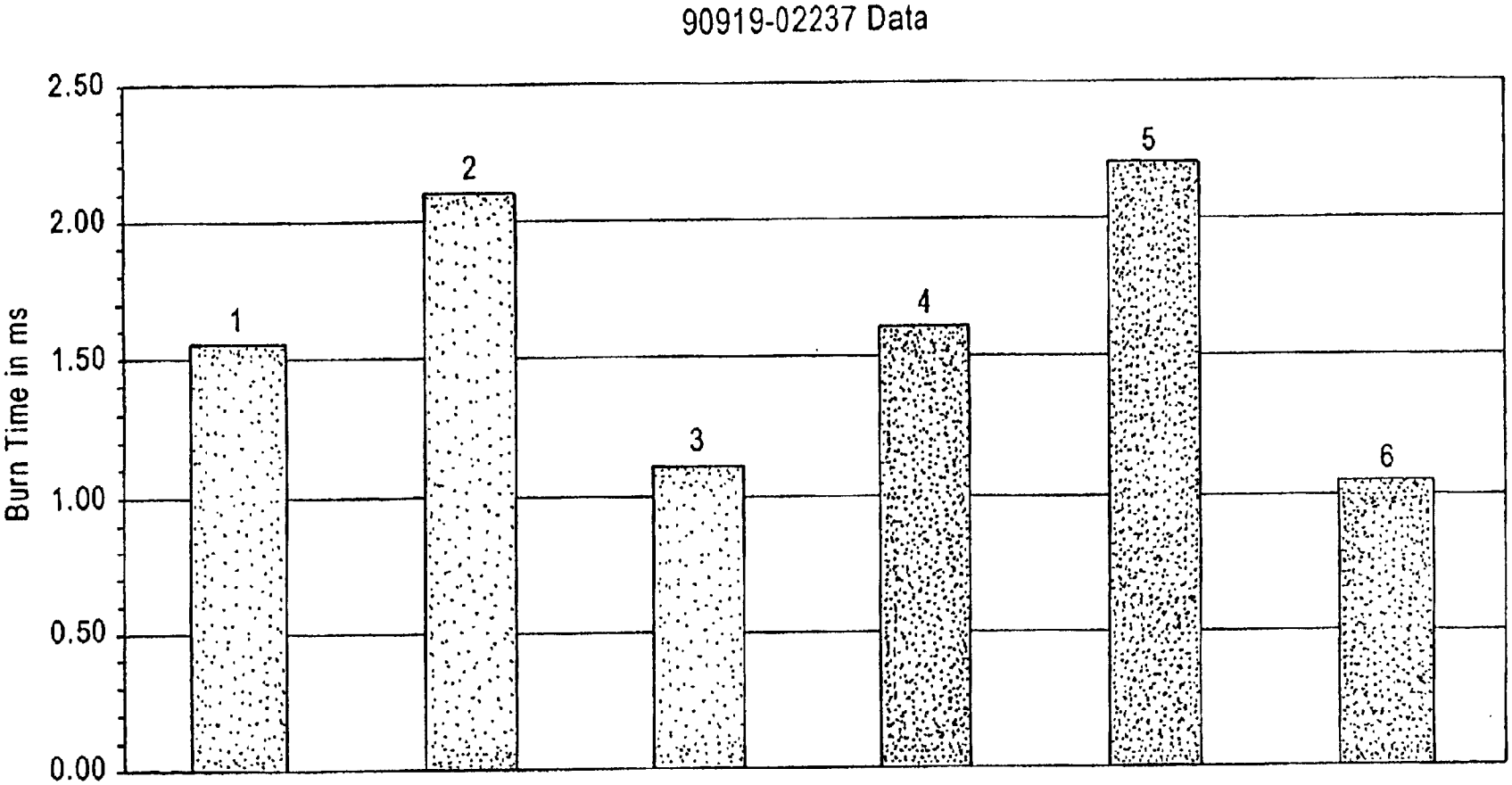
Figure 11F:
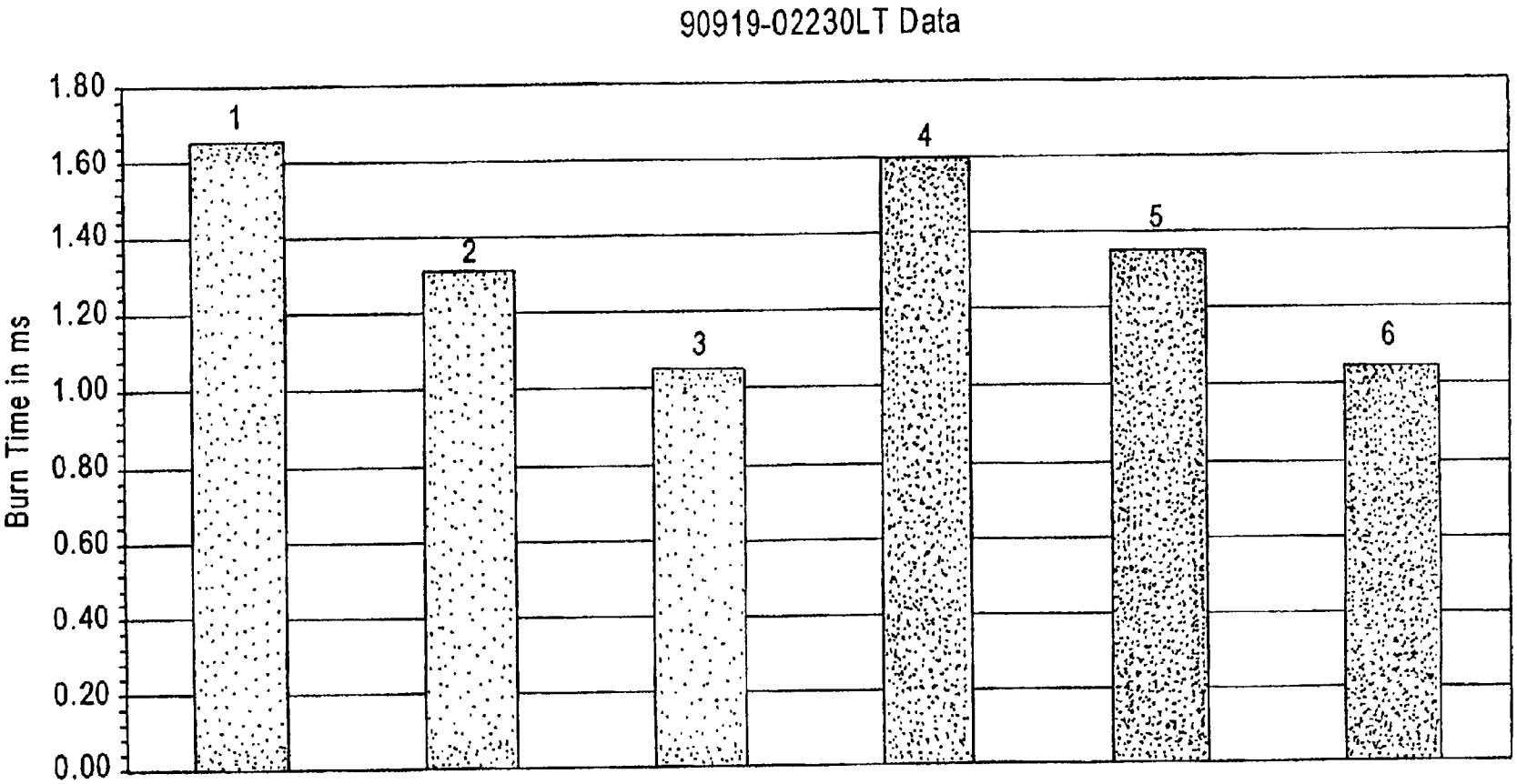
Figure 11G:
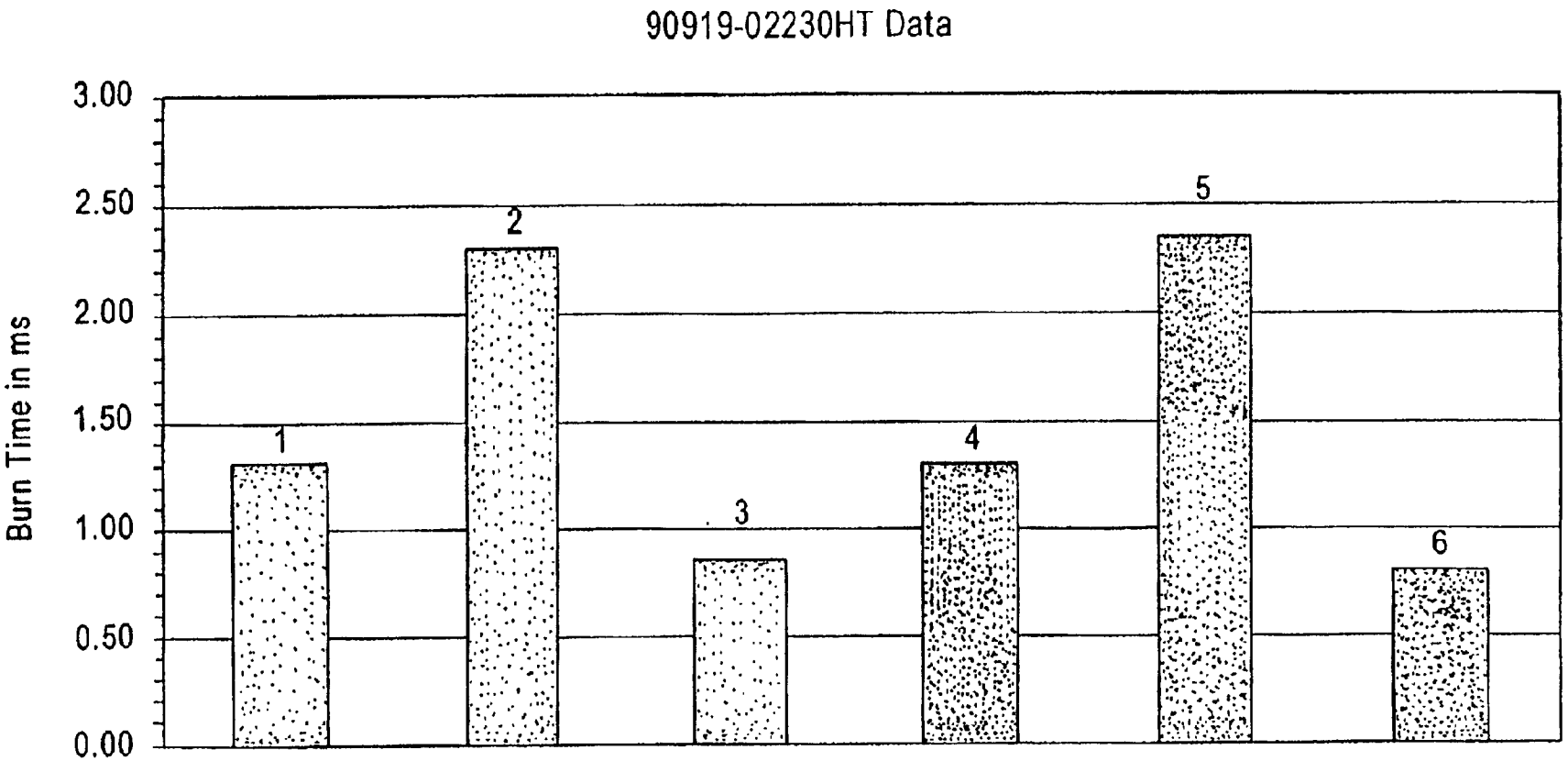
Figure 11H:
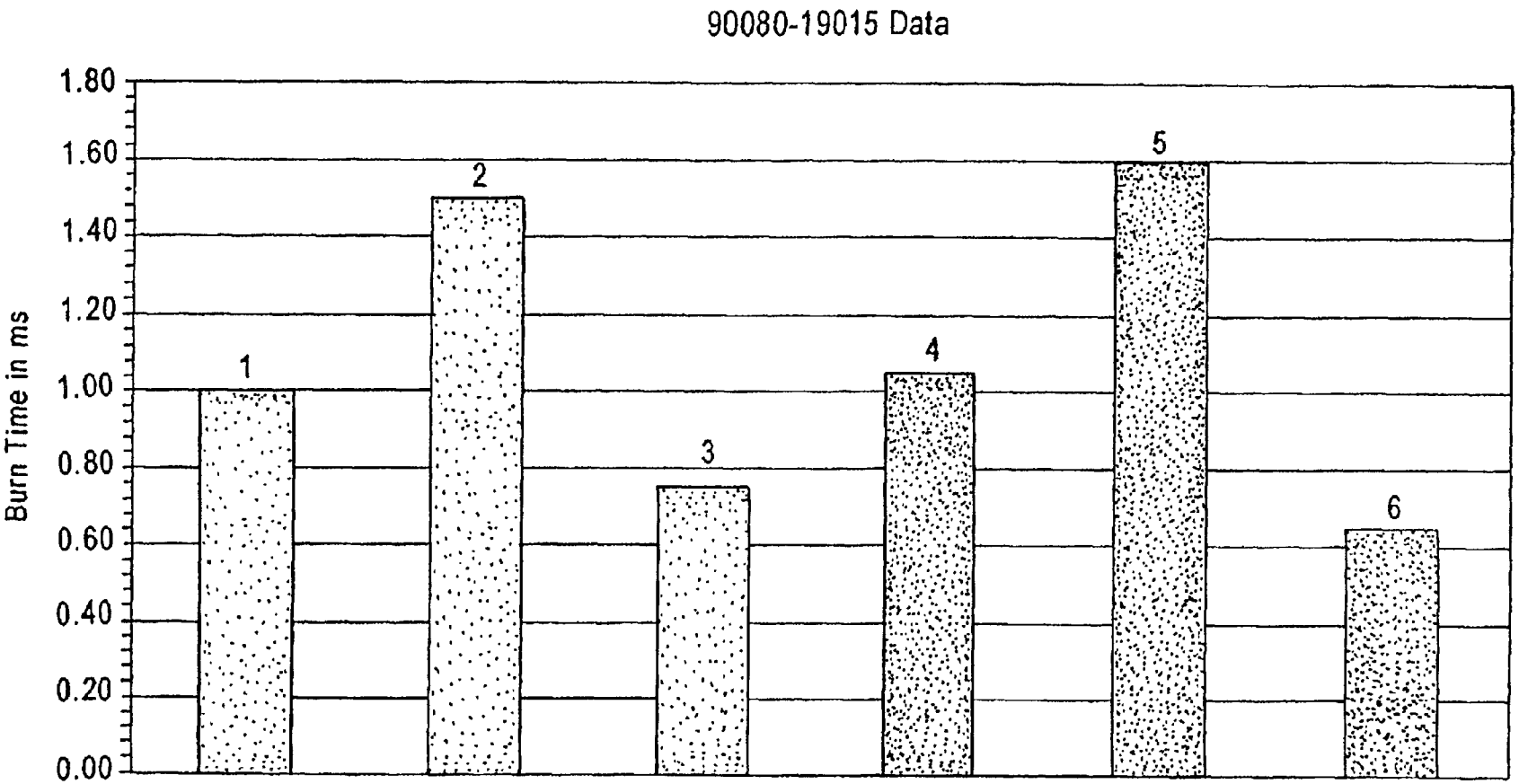

FIGS. 11*b*–11*h* relate to the 90919-02240, 90919-02239, 90919-02238, 90919-02237, 90919-02230LT, 90919-02230HT, and 90080-19015 COPs, respectively. These figures show a correspondence, similar to that depicted in FIG. 11*a*, between the oscilliscope and readings of burn time for a normal gap (1, 4), shorted gap (2, 5), and near open gap (3, 6) for each of the noted COPs. FIG. 11*b* (90919-02240 COP), for example, shows oscilloscope burn times for a normal gap (1.25 ms), shorted gap (2.5 ms), and near open gap (0.80 ms), while the burn times are for a normal gap (1.30 ms), shorted gap (2.55 ms), and near open gap (0.80 ms), respectively. FIG. 11*c* (90919-02239 COP), for example, shows oscilloscope burn times for a normal gap (1.05 ms), shorted gap (1.5 ms), and near open gap (0.70 ms), while the burn times are for a normal gap (1.05 ms), shorted gap (1.50 ms), and near open gap (0.65 ms), respectively.

Figure 12A:
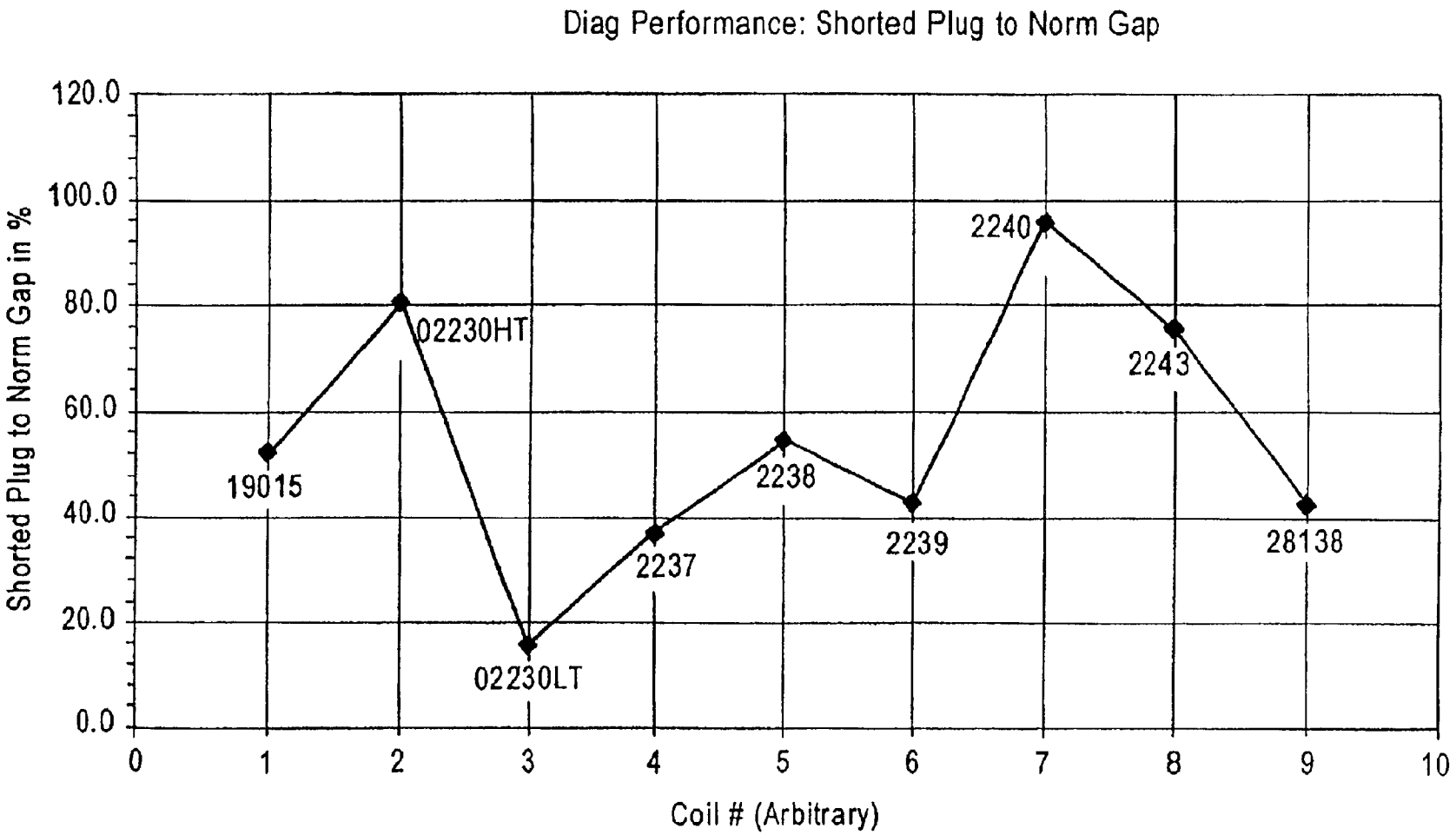
FIGS. 12*a*–12*b* show the diagnostic efficacy of the dual inductor coil on plug sensor.
Figure 12B:
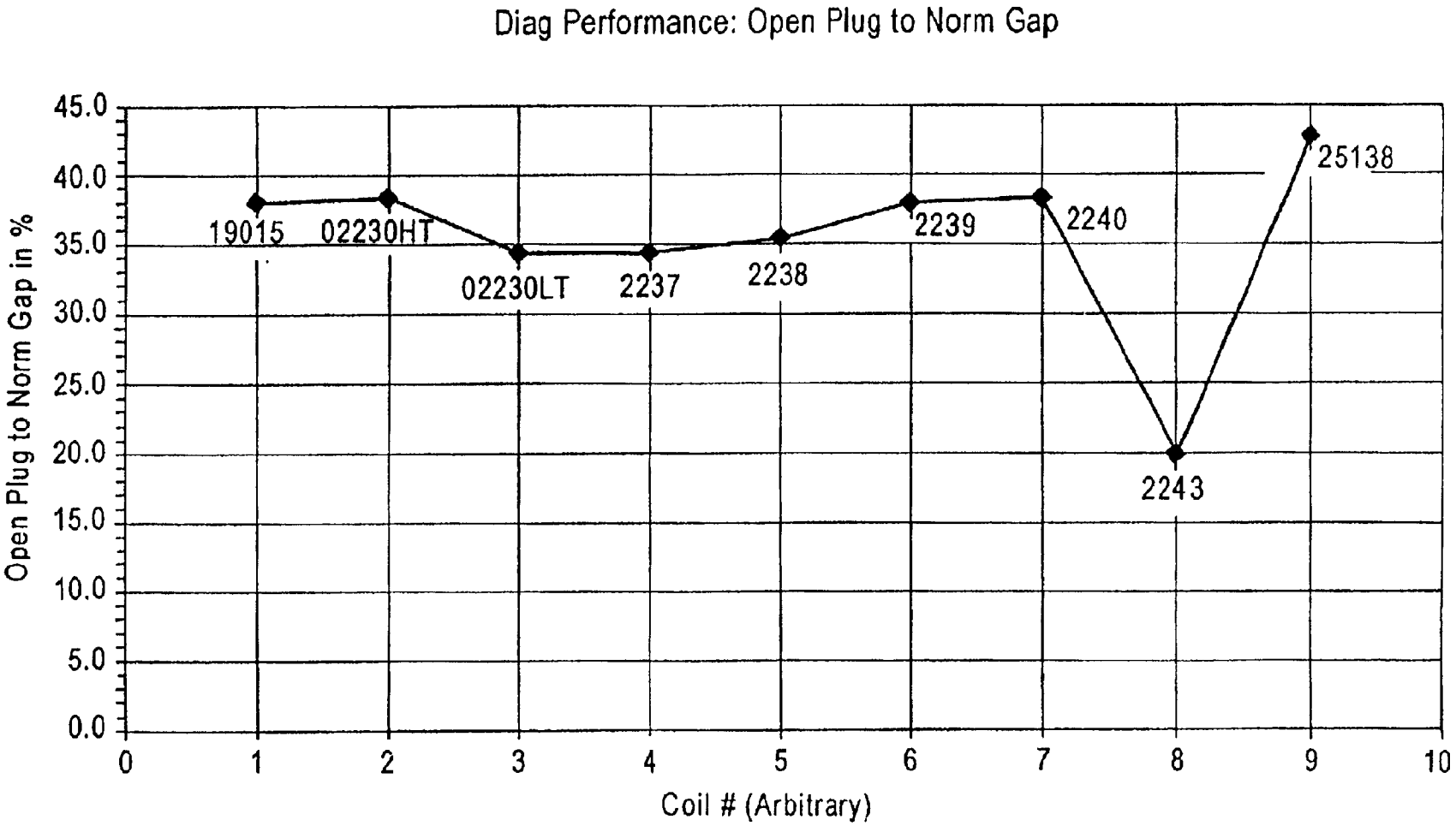

FIGS. 12*a*–12*b* show the diagnostic efficacy of the above embodiment of the dual inductor coil on plug sensor (DLCOP). FIG. 12*a* shows the relation between the shorted plug to the normal gap expressed as a percentile and a variety of coils, assigned an arbitrary numeric sequence and corresponding to the aforementioned COPs, indicated by the last digits of the COP manufacturer part number. FIG. 12*b* shows the relation between the open plug to the normal gap expressed as a percentile and a variety of coils, assigned an arbitrary numeric sequence and corresponding to the aforementioned COPs, indicated by the last digits of the COP manufacturer part number. The "Open to Norm %" is determined according to the absolute value of the difference between the normal gap burn minus the plug open burn, the difference divided by the normal gap burn and multiplied by 100. The "Short to Norm %" is similarly calculated with substitution of the plug short burn in lieu of the plug open burn. As illustrated, the higher the percentile, the easier it is for a user or technician to recognize the difference between a normally operating plug and one in which the plug (or circuit) is shorted. Coil #9 (28138) corresponds to a Jeep COP (Chrysler P/N 56028138). The remaining coils correspond to various Toyota COPs.

In accord with the above, the diagnostic value does not lie in exclusively in providing an exact value of firing voltage as there is not an exact correspondence between an actual firing voltage (i.e., Tek kV) and the inductively sampled voltage from flux (e.g., kV), although there is a general relation therebetween, as shown in the graphs of FIGS. 6*a*–9*b* and FIGS. 11*a*–11*h*. The diagnostic value also inheres in, for example, relative firing line magnitudes between each of a plurality of coil-on plugs to determine differences therebetween or in time-based phenomena, such as burn time, which are proportional to the actual firing voltage. For example, if a technician places an inductive sampling circuit over a plurality of coil-on plugs and all but one of the coil-on plugs has an equivalent firing line reading 6 kV and the outlier reads 20 kV, then it is probable that the 20 kV indicates a problem in need of further evaluation.

Burn time is an event whose magnitude may be extracted from the waveform measured using the inductive sampling technique, in accord with the disclosure herein, based on observation of known behaviors of the coil-on plug system, described generally in relation to FIGS. 2*a* and 2*b*, in a manner known to those skilled in the art.

The inductively coupled sampling of an ignition coil-on/coil-over plug spark plug (dubbed LCOP) in accord with the invention described herein realizes improvements over capacitively coupled sampling of an ignition coil-on/coil-over plug spark plug (dubbed CCOP), as the inventive inductively coupled sampling extends measurement capabilities into low coil fields.

As a point of comparison, a CCOP system delivers a reasonably linear relative representation of plug gap voltage immediately prior to break from (firing line or power kV) over the voltage range of DC to 50 kV, whereas the LCOP system delivers a non-linear relative representation over the voltage range of less than 10 kV to more than 30 kV. The CCOP and LCOP perform substantially equally with respect to measurement of the duration of plug gap breakdown (burn time, spark time). In ascertaining the voltage during burn time (spark line, spark kV, burn kV), the CCOP systems deliver reasonably linear representations over the range of less than 1 to above 4 kV, whereas the LCOP delivers a reasonably linear relative representation over the same voltage range. As to detection of problems, such as shorted or fouled spark plugs, the CCOP has a typical voltage across the spark plug gap during breakdown of only about 10 V and the burn time and power kV (voltage from top of resistor plug to ground) are low. The LCOP is similar; however, the power kV may appear normal. Diagnostically, the spark line may be used in the LCOP system, since the spark line drops to about 50% of normal. As to detection of an open within the coil secondary or within the plug or problems with the dwell time, the LCOP and CCOP are equally capable.

The embodiments described herein may include or be utilized with any appropriate voltage source, such as a battery, an alternator and the like, providing any appropriate voltage, such as about 12 Volts, about 42 Volts and the like.

The embodiments described herein may be used with any desired ignition system or engine. Those systems or engines may comprises items utilizing organically-derived fuels or fossil fuels and derivatives thereof, such as gasoline, natural gas, propane and the like or combinations thereof. Those systems or engines may be utilized with or incorporated into another systems, such as an automobile, a truck, a boat or ship, a motorcycle, a generator, an airplane and the like.

Various aspects of the invention have been discussed in the present disclosure to illustrate its versatility. It is to be understood that the invention is capable of use in various other combinations and environments and is capable of changes or modifications within the scope of the inventive concepts expressed herein. For example, a plurality of inductors could be used for a single coil-on plug. The inductive device could comprise a plurality of similar inductive devices or could comprise a combination of different inductive devices having different characteristics. Further, the method of the invention also broadly relates to use of a capactitive sensor, such as but not limited to that taught by as taught by U.S. Pat. No. 6,396,277, issued on May 28, 2002, incorporated herein by reference, to determine burn time. Moreover, although illustrative examples of the apparatus and method were discussed, the invention is not limited by the examples provided herein and additional variations of the invention are embraced by the claims appended hereto.

What is claimed:

1. A coil-on plug testing apparatus for generating an output signal representing an ignition signal, comprising:

an inductive sensor configured to be attachable to an exterior surface of a coil-on-plug device housing for detecting an electromagnetic flux generated by the coil-on plug device and output through said housing during a firing event and generating and outputting a voltage in response thereto;

a signal processing circuit electrically coupled to the inductive sensor for generating an output signal in response to variations in the voltage output by the inductive sensor in response to a detected electromagnetic flux.

2. The coil-on plug testing apparatus according to claim 1, wherein the inductive sensor comprises at least one of an open core inductor and an air core inductor.

3. The coil-on plug testing apparatus according to claim 1, including a housing bearing at least one of a clamp and a magnetic member for attaching the inductive sensor to the coil-on plug device.

4. The coil-on plug testing apparatus according to claim 1, including a housing bearing a biasing member for attaching the inductive sensor to the coil-on plug.

5. A coil-on plug testing apparatus for generating an output signal representing an ignition signal, comprising:

an inductive sensor configured to be attachable to a coil-on-plug device for detecting an electromagnetic flux generated by the coil-on plug device during a firing event and generating and outputting a voltage in response thereto;

a signal processing circuit electrically coupled to the inductive sensor for generating an output signal in response to variations in the voltage output by the inductive sensor in response to a detected electromagnetic flux, wherein the signal processing circuit comprises a RC circuit attached in shunt to the inductive sensor.

6. The coil-on plug testing apparatus according to claim 5, wherein the signal processing circuit comprises a Schottky diode attached in shunt to the inductive sensor.

7. The coil-on plug testing apparatus according to claim 5, wherein the signal processing circuit comprises a variable resistor.

8. The coil-on plug testing apparatus according to claim 5, wherein the inductive sensor comprises a variable inductor.

9. The coil-on plug testing apparatus according to claim 6, wherein the inductive sensor comprises a variable inductor.

10. A coil-on plug testing apparatus for generating an output signal representing an ignition signal, comprising:

an inductive sensor configured to be attachable to a coil-on-plug device for detecting an electromagnetic flux generated by the coil-on plug device during a firing event and generating and outputting a voltage in response thereto:

a signal processing circuit electrically coupled to the inductive sensor for generating an output signal in response to variations in the voltage output by the inductive sensor in response to a detected electromagnetic flux, wherein the signal processing circuit comprises a plurality of RC circuits bearing different combinations of resistor and capacitor, the plurality of RC circuits attached in shunt to the inductive sensor through a switching element.

11. The coil-on plug testing apparatus according to claim 10, wherein the switching element is a multi-position switch.

12. The coil-on plug testing apparatus according to claim 10, wherein the switching element is a digital switch.

13. A method for determining burn time for a coil-on plug ignition, comprising the steps of:

disposing an inductive sensor adjacent an exterior surface of a coil-on plug ignition housing;

using the inductive sensor to detect an electromagnetic flux output by the coil-on plug ignition through said housing during a period encompassing at least one firing section; and determining a burn time, wherein the step of determining a burn time comprises identifying a firing line equivalent and identifying an endpoint of a spark line and determining the time between the firing line and the endpoint of the spark line.

14. A method for determining burn time for a coil-on plug ignition according to claim 13, further comprising conditioning a voltage corresponding to the detected electromagnetic flux.

15. A method for determining burn time for a coil-on plug ignition according to claim 13, wherein the disposing step comprises removably attaching the inductive sensor to an exterior of the coil-on plug ignition housing.

16. A method for determining burn time for a coil-on plug ignition according to claim 13, wherein the disposing step comprises clamping at least one of the inductive sensor and an inductive sensor housing to the coil-on plug ignition housing.

17. A method for determining burn time for a coil-on plug ignition according to claim 13, wherein the disposing step comprises clamping at least one of the inductive sensor and an inductive sensor housing to an engine compartment component.

18. A method for determining burn time for a coil-on plug ignition according to claim 13, further comprising outputting the determined burn time to at least one of a display device, a printing device, and an indicating device.

19. A method for determining burn time for a coil-on plug ignition according to claim 13, further comprising the step of disposing a plurality of inductive sensors adjacent to a corresponding plurality of coil-on plug ignition housings.

20. A method for detecting problems associated with a coil-on plug ignition, comprising the steps of:

a) disposing an inductive sensor adjacent a first coil-on plug housing;

b) using the inductive sensor to detect an electromagnetic flux output by the coil-on plug ignition during a period encompassing at least one firing section;

c) identifying at least one of a firing line, spark line, and burn time;

d) repeating steps a)–c) for a second coil-on plug; and e) comparing at least one of a corresponding firing line, spark line, and burn time identified with respect to the first and second coil-on plugs to determine a relative difference therebetween.

21. A method for detecting problems associated with a coil-on plug ignition according to claim 20, wherein step e) comprises comparing a burn time identified with respect to the first and second coil-on plugs to determine a relative difference therebetween.

* * * * *